US005337363A

United States Patent [19]

Platt

[11] Patent Number: 5,337,363

[45] Date of Patent: Aug. 9, 1994

[54] METHOD FOR GENERATING THREE DIMENSIONAL SOUND

[75] Inventor: David C. Platt, Mountain View, Calif.

[73] Assignee: The 3DO Company, Redwood City, Calif.

[21] Appl. No.: 970,274

[22] Filed: Nov. 2, 1992

[51] Int. Cl.[5] ..... H04S 5/00

[52] U.S. Cl. ..... 381/17; 381/61

[58] Field of Search ..... 381/1, 17, 18, 26, 61

[56] References Cited

U.S. PATENT DOCUMENTS

| | | | |
|---|---|---|---|
| 3,665,105 | 5/1972 | Chowning | 381/17 |
| 4,648,115 | 3/1987 | Sakashita | 381/17 |
| 4,731,848 | 3/1988 | Kendall et al. | 381/63 |
| 4,792,974 | 12/1988 | Chace | 381/1 |
| 4,817,149 | 3/1989 | Myers | 381/1 |
| 4,908,858 | 3/1990 | Ohno | 381/1 |
| 5,046,097 | 9/1991 | Lowe et al. | 381/17 |

FOREIGN PATENT DOCUMENTS

| | | | |
|---|---|---|---|
| 53-137101 | 11/1978 | Japan | 381/1 |
| 58-68400 | 4/1983 | Japan | 381/1 |
| 62-140600 | 6/1987 | Japan | 381/1 |

OTHER PUBLICATIONS

Loomis et al., *Active localization of virtual sounds,* J. Acoust. Soc. Am., vol. 88, No. 4, Oct. 1990, pp. 1757–1764.

Wallach et al., *The Precedence Effect in Sound Localization,* J. Audio Eng. Soc., vol. 21, No. 10, Dec. 1973, pp. 817–826.

Rodgers, *Pinna Transformations and Sound Reproduction,* J. Audio Eng. Soc., vol. 29, No. 4, Apr. 1981, pp. 226–234.

Madsen, *Extraction of Ambiance Information from Ordinary Recordings,* J. Audio Eng. Soc., vol. 18, No. 5, Oct. 1970, pp. 490–496.

Wiener, *On the Diffraction of a Progressive Sound Wave by the Human Head,* J. Acoust. Soc. Am., vol. 19, No. 1, Jan. 1947, pp. 143–146.

Hebrank et al., *Are two ears necessary for localization of sound sources on the median plane?,* J. Acoust. Soc. Am., vol. 56, No. 3, Sep. 1974, pp. 935–938.

Shaw, *Earcanal Pressure Generated by a Free Sound Field,* J. Acoust. Soc. Am., vol. 39, No. 3, 1966, pp. 465–470.

Mehrgardt, *Transformation characteristics of the external human ear,* J. Acoust. Soc. Am., vol. 61, No. 6, Jun. 1977, pp. 1567–1576.

Roffler et al., *Localization of Tonal Stimuli in the Vertical Plane,* J. Acoust. Soc. Am., vol. 43, No. 6, 1968, pp. 1260–1266.

Gardner et al., *Problem of localization in the median plane: effect of pinnae cavity occlusion,* J. Acoust. Soc. Am., vol. 53, No. 2, 1973, pp. 400–408.

Handbook For Sound Engineers: The New Audio Cyclopedia, *Acoustics–Psychoacoustics,* 1987 by Howard W. Sams & Co., pp. 25–39.

(List continued on next page.)

*Primary Examiner*—Forester W. Isen

*Attorney, Agent, or Firm*—Fliesler, Dubb, Meyer & Lovejoy

[57] ABSTRACT

A method for producing three dimensional sound associated with an object that is moving from a first position to a second position with respect to the listener. The method includes the effects of doppler shifting, head shadowing, distance on frequency components of the sound as well as the volume of the sound, and the natural sensitivity of the human ear in the 7–8 kHz range. The method provides a sequence of digital sound samples which when converted into analog waveforms and for production of audio signals will provide an audio signal which will provide sound queues to the listener for the location of the sound in three dimensional space.

21 Claims, 6 Drawing Sheets

OTHER PUBLICATIONS

McGreevy, *Virtual Reality and Planetary Exploration,* 29th AAS Goddard Memorial Symposium, Mar. 1991, pp. 1–23.

Wenzel et al., *A Virtual Display System For Conveying Three-Dimensional Acoustic Information,* Proceedings of the Human Factors Society–32nd Annual Meeting, 1988, pp. 86–90.

Wightman et al., *Headphone simulation of free-field listening. I: Stimulus synthesis,* J. Acoust. Soc. Am., vol. 85, No. 2, Feb. 1989, pp. 858–867.

Linkwitz, *Improved Headphone Listening: Build a stereo-crossfeed circuit,* Audio, Dec. 1971, pp. 42–43.

Eargle, *An 'Earing 'Earing,* Audio, Sep. 1990, pp. 25–32.

Pohlmann, *Psycho-What? Psychoacoustics,* Stereo Review, Sep. 1989, pp. 117–120.

Klein, *Audio Update: Can you believe your ears?,* Radio-Electronics, Dec. 1987, pp. 40–45.

Feldman, *Beyond Stereo: The Sound Retrieval System adds a new dimension to audio reproduction,* Radio-Electronics, Sep. 1989, pp. 51–54.

Vaughan, *How We Hear Direction,* Audio, Dec. 1983, pp. 51–55.

Roffler et al., *Factors That Influence the Localization of Sound in the Vertical Plane,* J. Acoust. Soc. Am., vol. 43, No. 6, 1968, pp. 1255–1259.

METHOD FOR GENERATING THREE DIMENSIONAL SOUND

A portion of the disclosure of this patent document contains material which is subject to copyright protection. The copyright owner has no objection to the facsimile reproduction by anyone of the patent document or the patent disclosure as it appears in the U.S. Patent and Trademark Office patent file or records, but otherwise reserves all copyright rights whatsoever.

CROSS-REFERENCE TO RELATED APPLICATIONS

This application is related to:

PCT Patent Application Serial No. PCT/US92/09349, entitled AUDIO/VIDEO COMPUTER ARCHITECTURE, by inventors Mical et al., filed concurrently herewith, and also to U.S. patent application Ser. No. 07/970,308, bearing the same title, same inventors and also filed concurrently herewith;

PCT Patent Application Serial No. PCT/US92/09342, entitled RESOLUTION ENHANCEMENT FOR VIDEO DISPLAY USING MULTI-LINE INTERPOLATION, by inventors Mical et al., filed concurrently herewith, and also to U.S. patent application Ser. No. 07/970,287, bearing the same title, same inventors and also filed concurrently herewith;

PCT Patent Application Serial No. PCT/US92/09350, entitled METHOD FOR CONTROLLING A SPRYTE RENDERING PROCESSOR, by inventors Mical et al., filed concurrently herewith, and also to U.S. patent application Ser. No. 07/970,278, bearing the same title, same inventors and also filed concurrently herewith;

PCT Patent Application Serial No. PCT/US92/09462, entitled SPRYTE RENDERING SYSTEM WITH IMPROVED CORNER CALCULATING ENGINE AND IMPROVED POLYGON-PAINT ENGINE, by inventors Needle et al., filed concurrently herewith, and also to U.S. patent application Ser. No. 970,289, bearing the same title, same inventors and also filed concurrently herewith;

PCT Patent Application Ser. No. PCT/US92/09460, entitled METHOD AND APPARATUS FOR UPDATING A CLUT DURING HORIZONTAL BLANKING, by inventors Mical et al., filed concurrently herewith, and also to U.S. patent application Ser. No. 07/969,994, bearing the same title, same inventors and also filed concurrently herewith;

PCT Patent Application Serial No. PCT/US92/09461, entitled IMPROVED METHOD AND APPARATUS FOR PROCESSING IMAGE DATA, by inventors Mical et al., filed concurrently herewith, and also to U.S. patent application Ser. No. 07/970,083, bearing the same title, same inventors and also filed concurrently herewith; and PCT Patent Application Serial. No. PCT/US92/09384, entitled PLAYER BUS APPARATUS AND METHOD, by inventors Needle et al., filed concurrently herewith, and also to U.S. patent application Ser. No. 07/970,151, bearing the same title, same inventors and also filed concurrently herewith.

The related patent applications are all commonly assigned with the present application and are all incorporated herein by reference in their entirety.

BACKGROUND OF THE INVENTION

Field of the Invention

The invention relates to a method for generating three dimensional binaural sound from monaural digital sound samples that are associated ,with an object where that object is moving with respect to the listener.

Description of the Related Art

Over the past twenty years much work has been done in the area of sound processing to create the sensation that the sound being generated is in three dimensional space and not located from the loud speakers generating the sound. It is well understood in the field of acoustics that there are sound queues which allow a listener to locate the source of the sound in three dimensional space. Much of the work has been directed towards sound processing of pre-recorded sounds on records, tapes, laser discs, etc., to give the listener the illusion that the sound is located in three dimensional space and not solely to the speakers generating the sound. Such art, by way of example, can be found in U.S. Pat. No. 4,817,149, entitled "Three Dimensional Auditorial Display Apparatus and Method Utilizing Enhanced Bionic Emulation of Human Binaural Sound Localization", Inventor: Peter H. Meyers, Issued Mar. 28, 1989.

The article "Active Localization of Virtual Sounds", Jack M. Loomis, Chick Herbert, Joseph G. Cicinelli, Journal of the Acoustical Society of America, Volume 88(4), p. 1757, October 1990, describes a system in which monaural sound is generated and then sound queues are added to the sound such that the person listening to the generated sound through a headset has the sensation that the sound is being generated in three dimensional space. This article also describes and accounts for the movement of a persons head to aid in the location of a sound source.

U.S. Patent entitled "Sounds Imaging Process", U.S. Pat. No. 5,046,097, Inventors: Danny D. Lowe et al., Issued Sep. 3, 1991, describes a digital processing system for adding sound queues to produce the illusion of distinct sound sources being distributed throughout three dimensional space while using conventional stereo playback equipment.

Work is presently being done in the field entitled "Virtual Reality" which includes both three dimensional visual displays as well as three dimensional sound. Further, with the advent of home computers and interactive visual communication systems using home television sets as a video display means, it has become desirable to be able to generate a three dimensional sound or sounds associated with an object or objects appearing on the television screen and further to allow the listener and viewer to make interactive decisions with what is being displayed on the screen.

For example, if in a given video game situation the player observes a train moving from his right to left and towards him, it would be desirable to have the sound associated with the train not only .give the queues as to the location of the train as it moves between the two locations, but to also include the doppler shift associated with the movement of the train as it moves toward or away from the player. Further, if the listener has the means of controlling his relative position with regard to what is being observed on the screen, the sound being generated must reflect the relative movement made by the listener. In that the relative position of the sound source, i.e. object on the screen, and the listener is no longer fixed, a method must be used to produce the sound being generated on a real time basis.

SUMMARY OF THE INVENTION

Accordingly, it is an object of the present invention to provide a method for generating sound associated with an object as that object travels from a first location to a second location.

It is a further object of the invention for the method to include the doppler shift associated with the relative movement of the object and the listener.

It is another object of the invention to provide a method which incorporates sound queues to aid the listener in locating the object in three dimensional space.

The preferred embodiment of the invention is to be implemented by a computer program. The method calls for input data indicative of the location (X and Y coordinates) and the time associated with a start point and end point of travel of the object. Inputs to the method can also comprise a descriptor of the amount of reverberation in the environment in which the action is taking place and, secondly, the relative loudness of the sound associated with the object. One set of input data is called a segment. The user continuously processes segments to define the relative movement of the object and the listener. The segments must be short enough in duration to allow the method to produce the proper sound as the player interacts with the system.

The method first determines if the input segment to the system meets the segment requirements of the system. If the segment is too large the segment is broken into subsegments until all subsegments meet the criteria of the method. The subsegments are ordered sequentially so they define the initial segment to the system.

Each subsegment is then processed sequentially. From the input data associated with the segment or subsegment being processed, ratios are formed for both ears as well as the value for various multipliers used in the reverberation, frequency shaping, and amplitude control portion of the method. The method uses monaural digital sound samples stored in the memory. These monaural sound samples have been sampled at the compact disc (CD) audio rate of 44.1 kHz. The method will generate digital output sound samples at the same rate, i.e. 44.1 kHz. A tick is the period of the frequency 44.1 kHz and is used as a basic time unit in the method.

The method uses the ratio for each ear to control the rate at which monaural sound samples for each ear are taken from memory. The source sound samples are taken consecutively from the memory. By this method the sound represented by the source sound samples can be compressed or elongated in time to provide the effect of the doppler shift caused by the object moving towards or away from the listener. During each tick one digital output sound sample is generated for each ear. The generated sound samples for each ear are processed separately.

The generated sound samples for each ear are processed for reverberation and passed through a combined notch and low pass filter for frequency shaping. The samples are then processed for amplitude adjustment which is a function of the distance between the listener and the object and the relative loudness of the sound. The processed digital output sound sample for each ear for each tick is stored in memory. Samples for each ear are taken from memory at the rate of 44.1 kHz and passed through a digital to analog converter. The resulting analog signal for each ear is fed to respective sides of a set of earphones.

BRIEF DESCRIPTION OF THE DRAWINGS

The invention will be described with respect to particular embodiments thereof and reference will be made to the drawings, in which.

DESCRIPTION OF THE PREFERRED EMBODIMENTS

The method of this invention is used to generate the sound that an object associated with that sound would make as the object travels through three dimensional space, The method generates the sound on a real time basis thereby allowing the sound generated to be responsive to the interaction between the listener and the system the listener is using. One use for this method is in computer games which allows the viewer to interact with the computer system the viewer is using to play the game, However, the use of this method is not limited simply to computer games and may be used wherever virtual sound is desired.

The method is carried out by a computer program stored within a processor that has a computer having the capacity and speed to perform the method included within the program.

This method is to be used with other programs which will provide segment data to the method containing necessary parameters to generate the given sound, Table 1 lists the segment data provided to the method and the constants used by the method. Table 2 lists the parameters that will be calculated in order to practice the method, All of the parameters to be calculated as show in Table 2 are well known in the art and can be found in any physics text.

The basic unit of distance is 0.1 meters. The basic unit of time is derived from the CD recording rate of 44.1 kHz. The basic unit of time is one cycle of that frequency and is referred to as a tick. Therefore there are 44,100 ticks per second. The time between ticks, 226 μsec, is the amount of time that the processor has to perform the method practiced by this invention.

The method has five major parts. The first part is segment determination for determining if the segment given to the system meets the requirements and criteria of the method. The second part is the generation of a digital sound sample for each ear as a function of the position of the object and the listener for each tick of the segment. This portion also adjusts for the doppler effect caused by the object moving relatively toward or away from the listener. The third portion is the addition of reverberation to the generated sound sample. The user of the method can define the reverberation characteristics of the environment in which the object exists. The fourth portion is frequency shaping for the purpose of inserting queues to the listener for positioning the object in three dimensional space. The fifth portion is volume adjusting to account for the decrease in the loudness of the sound as the sound travels the distance between the listener and the object and for the relative initial loudness of the sound generated by the object. For example, a jet engine at 1,000 yards will be heard very clearly while a human voice at that same distance will not. Thus the method defines and accounts for the variable in initial loudness or power of the sound which is to be defined by the user.

Figure 1:
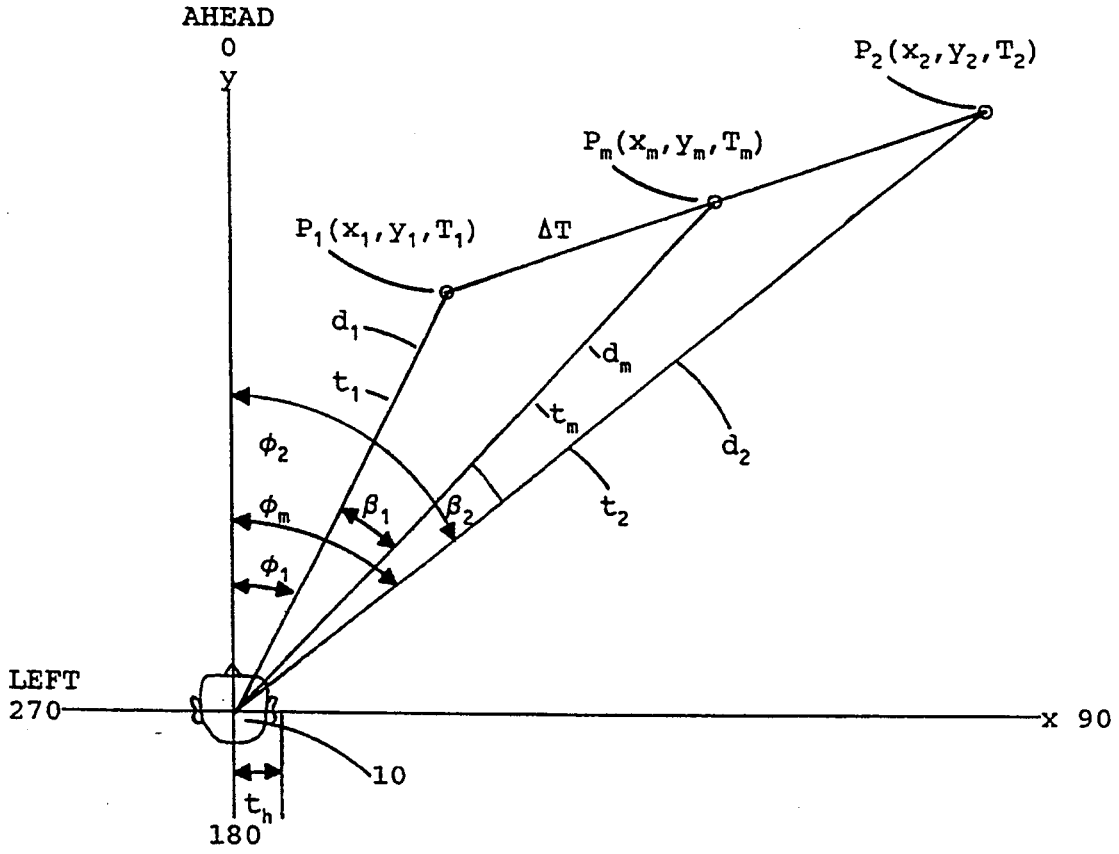
FIG. 1 is a diagram indicating the movement of an object from point $P_1$ to $P_2$ and depicts the parameters and orientation used in the invention.

FIG. 1 illustrates the listener 10 observing an object going from point $P_1$ to point $P_2$ and the various parameters used by the method. It is understood that the location of the object is purely for exemplary purposes and the method operates for an object moving between any two points in three dimensional space around the listener. In the method the listener is always at the center of the coordinate system and the object moves relative to the listener. Where the listener can interact with the systems such that the listener can change the relative motion, such a change in relative motion is dealt with by rotating the axes of the system in an appropriate manner. The rotation of the coordinate system is not included within this method. Such a motion change would be reflected in the next segment of data sent to the method for sound generation.

A segment is defined as a start point $P_1$ and an end point $P_2$ Both points are defined by X,Y coordinates in units of distance of the system. The time, $T_1$ and $T_2$, at which the object is at $P_1$ and $P_2$ are also provided.

TABLE 1

| Symbol | Description |
|---|---|
| | INPUTS TO METHOD (Segment Data) |
| $P_1(X_1,Y_1)$ | Location of object at start of segment. |
| $T_1$ | Time of start of segment. |
| $P_2(X_2,Y_2)$ | Location of object at end of segment. |
| $T_2$ | Time of end of segment. |
| | CONSTANTS |
| $t_h$ | One-half the time for sound to travel the width of the head (12.5 ticks). |
| S | Speed of Sound in medium (for air = 315 m/sec). |
| R | Sample Rate of Stored Sound Sampler (14,100 kHz). |
| Rev | Reverberation characteristic of location. |
| Lou | Comparative Loudness setting for object. |

TABLE 2

| Symbol | Description |
|---|---|
| | CALCULATED VALUES |
| $P_m$ | Midpoint between $P_1$ and $P_2$. |
| $T_m$ | Midpoint between $T_1$ and $T_2$. |
| $d_1$ | Distance from $P_1$ to the center of the listener's head. |
| $d_2$ | Distance from $P_2$ to the center of the listener's head. |
| $d_m$ | Distance from $P_m$ to the center of the listener's head. (Average distance.) |
| $t_1$ | Time for sound to travel the distance $d_1$. |
| $t_2$ | Time for sound to travel the distance $d_2$. |
| $t_m$ | Time for sound to travel the distance $d_m$. |
| $\phi_1$ | Angle between Y axis and point $P_1$. |
| $\phi_2$ | Angle between Y axis and point $P_2$. |
| $\phi_m$ | Angle between Y axis and point $P_m$. (Average angle.) |
| $\beta_1$ | Angle between $P_1$ and $P_m$. |
| $\beta_2$ | Angle between $P_2$ and $P_m$. |

Segment Determination

When a new segment is defined for the method, the method will first determine if the segment defined meets the criteria of the method. The criteria area:

1. If the value of the midpoint distance, $d_m$, is less than 10 units (1 meter), then use the segment set as presented.
2. If angle $\beta_1$ is less than 5°, and if angle $\beta_2$ is less than 5°, and if the difference between distance $d_1$ and $d_m$ is less than 5% of $d_m$, and if the difference between $d_2$ and $d_m$ is less 5% of $d_m$, then use the segment as presented otherwise divide the segment into subsegments.

If the conditions above are not met such that the segment has to be divided, then the segment is divided at the midpoint generating two new segments. The first portion of the first subsegment would have a start point $P_1$, a stop point $P_m$, and a start time $T_1$, and an end time $T_m$. The second segment would have as its parameters the start point $P_m$ and the end point $P_2$, the start time of $T_m$ and the end time of $T_2$. Each of those subsegments would then be tested against the criteria to assure that the subsegment meets the criteria. If a subsegment meets the criteria then the subsegment is used. If the subsegment does not meet the criteria it is divided. This process is continued until all subsegments meet the criteria. The resulting subsegments are kept in order such that the final number of subsegments, when taken in sequence, will continuously form the segment as originally defined by the user.

Sample Generation

For the sake of discussion it will be assumed that the parameters shown in FIG. 1 meet the criteria of a segment and, therefore, the segment did not have to be divided. The method next generates sound samples at the rate of 44.1 kHz that will correspond to the sound generated by the object as the object moves between $P_1$ and $P_2$.

The time that sound would be generated by the object is $\Delta T$, the difference between time $T_1$ and $T_2$. Since the object is moving away from the listener in FIG. 1, the time $t_2$ for sound to reach the listener from the end point $P_2$ will be greater than the time $t_1$ for sound to reach the listener from the start point $P_1$. Therefore the listener will hear sound for a longer period of time than the time sound was actually generated by the object. Conversely, the listener will hear sound for a shorter period of time than the time sound was generated by the object as it moves from $P_1$ to $P_2$. This gives rise to a change in pitch of the sound which is commonly referred to as the doppler effect. The method further takes into account the difference in time for the sound to be heard by the right and left ear of the listener as a function of the location of the sound in the coordinate system as shown in FIG. 1. Clearly if the object is located as shown in FIG. 1, the listener's right ear will receive sound waves earlier than the left ear. The method generates for each ear a ratio between the length of time that the sound would have been generated by the object as it moved from $P_1$ to $P_2$, to the length of time that the listener hears the sound that would have been generated as the object moved from $P_1$ to $P_2$. The ratio includes a correction factor to adjust for the location of the object with reference to the listener's ears.

An assumption is made that the time for sound to travel the distance between the listener's ears ($2t_h$) is very small when compared to $\Delta T$, the time that the sound was generated. Further, since the time that the sound is heard by the listener is of the same magnitude as $\Delta T$, then the time for sound to travel between the listener's ears, $2t_h$, is much smaller than the time sound is heard by the listener.

The ratio is first derived for the center of the head as follows:

Time sound would be generated:

$$\Delta T = T_2 - T_1 \tag{1}$$

Time sound would be heard by the listener using the center of the listener's head as a reference:

$$\Delta t = (T_2 + d_2/s) - (T_1 + d_1/s) \tag{2}$$
$$= (T_2 - T_1) + (d_2/s - d_1/s) \tag{3}$$

however, $d_2/s$ are in units of decimeters/sec.

Converting the speed of sound to dm/tick, yields $$S = 3150\,\frac{\text{dm}}{\text{sec}} \times \frac{\text{sec}}{44{,}100\text{ ticks}} = 0.0714285\,\frac{\text{dm}}{\text{tick}}.$$

Thus, $$t_2\text{ (ticks)} = d_2/s = \frac{d_2\text{ dm}}{0.07142285\text{ dm/tick}} = 14d_2\text{ (ticks)}.$$

In a similar manner $t_1$ (ticks) $= 14d_1$ (ticks)

Thus, $$\Delta t = (T_2 - T_1) + (14d_2 - 14d_1) \tag{4}$$

$$\text{Ratio (center of head)} = \frac{\Delta T}{\Delta t} \tag{5}$$

$$\text{Assume } t_h << \Delta T \text{ and } \Delta t \tag{6}$$

Correction for center of head to each ear is:

$$\delta = t_n(\sin\phi_1 - \sin\phi_2) \tag{7}$$

Ratio (right ear) is:

$$R_R = \Delta T/(\Delta t - \delta) \tag{8}$$

Ratio (left ear) is:

$$R_L = \Delta T/(\Delta t + \delta) \tag{9}$$

Since $\delta$ can have a maximum value of 25 ticks, we can assume that $\delta << \Delta t$. Further assume that the speed of the object is small when compared to the speed of sound. Under such assumption:

$$R_R \approx (\Delta T + \delta)/\Delta t \tag{10}$$

$$R_L \approx (\Delta T - \delta)/\Delta t \tag{11}$$

Equations (10) and (11) can be used when the criteria for segment determination has been used to limit the size of the segment. If the criteria for segment determination has not been used or made less stringent, then equations (8) and (9) should be used for the ratios.

The ratios for the right and left ear are generated once for each segment and is used throughout the segment for the purpose of generating sound samples. A sound sample is generated for each ear for each tick in the segment. It is envisioned that a segment will be changed once to twice a second. Therefore a segment will have 22,000 to 44,100 ticks and thus 22,000 to 44,100 sound samples will be generated for each ear for each segment.

The method at this stage is divided for the right and left ear. The description hereinafter will be with regard to the right ear, but it should be understood that the same processing is done for the left ear.

Ratio for the right ear, $R_R$, will be composed of two parts, an integer part and a fraction part. Where the object is going away from the listener, the integer part will be 0 and if the object is coming towards the listener, then the integer portion of the ratio will be 1. For each cycle of operation, i.e. a tick, the ratio $R_R$ is added to the fractional portion of the summation ratio of the previous cycle. The results of this addition leads to a summation ratio for the right ear. Thus, by adding a fractional portion of a previous number to a number having an integer and fractional portion, the resulting summation ratio can have the integer portion to be equal to 1 if originally 0, and 2 if originally 1.

The integer portion is then used to select the samples from the monaural digital samples for the sound that has been stored in memory for use with this process.

It should be understood that the user of this method can store any monaural digital sampled sound in the memory. It is further well understood in the art that the time necessary for the monaural digital sound samples to describe the actual sound may be short. Therefore the monaural digital sound samples associated with the sound are looped so as to give a continuous source of digital sound samples of the sound to be generated. In the event there is a requirement that the monaural digital sound samples are greater in number than the allocated memory space, it is well within the art for the user to update the memory with new monaural digital sound samples as they are needed.

As previously stated, the integer portion of the summation ratio is used to control the number of monaural sound samples withdrawn from memory. The last two monaural sound samples that have been retrieved from the memory are used to generate the digital sound sample for the present tick. Interpolation is done between the two values of the sound sample using the fractional portion of the summation ratio. The interpolated value then becomes the generated digital sound sample for that tick for further processing during the tick.

Figure 2:
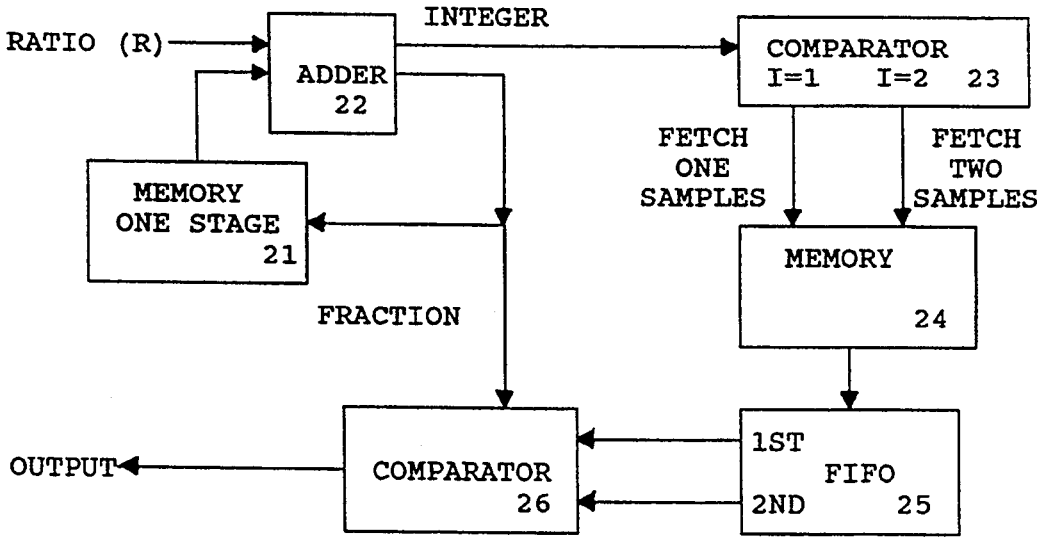
FIG. 2 is a logic diagram representative of the method for generating a digital sound sample as a function of the ratio.

FIG. 2 is a logic diagram which logically depicts this portion of the method. Memory 21 stores the fractional portion D of the summation that results from adder 22. Adder 22 has as its inputs the ratio for the right ear $R_R$ and the fractional portion D of the previous summation from the previous cycle stored in memory 21. After a new summation is done by adder 22, the new fractional portion D is stored in memory 21 to be used during the next cycle or tick. The integer portion I is sent to a comparator 23 to be tested. If the integer I is equal to 1 then the next monaural sound sample value is taken from memory 24 and stored in a two-stage FIFO 25. If the integer is equal to 2 then the next two monaural sound samples are taken from memory 24 and transferred to FIFO 25. If the tick has an integer value equal to 0 then the previous two fetched monaural sample values will still exist in FIFO 25. If one sample was fetched then FIFO 25 would have the previous sample that was fetched from memory 25 plus the present sample that has been fetched during this cycle. If two new samples were fetched from the memory 24, FIFO 25 will have the two samples stored this cycle. Interpolation is then done by interpolator 26 between the values of the two samples in FIFO 25 using the fractional portion D of the summation ratio. The interpolator 26 generates a digital sound sample for further processing by the remaining portion of the method.

Figure 3:
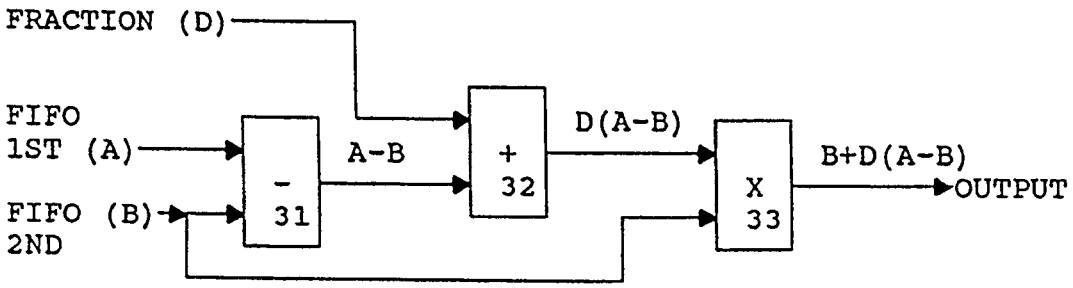
FIG. 3 is a logic diagram representative of the method used for interpolation.

FIG. 3 is a logic diagram of the interpolator 26 of FIG. 2. The interpolation is straightforward. The digital values stored in the second stage of FIFO 25 are subtracted from the digital values stored in the first stage of FIFO 25 yielding the difference between those two values. This difference (A−B) is then multiplied by multiplier 32 by the fractional portion D of the summation ratio to yield D(A−B). The output of multiplier 32 is then added together with the digital value of the first stage of FIFO 25 by adder 33 yielding the interpolated value for the sound sample for that tick.

Figure 4:
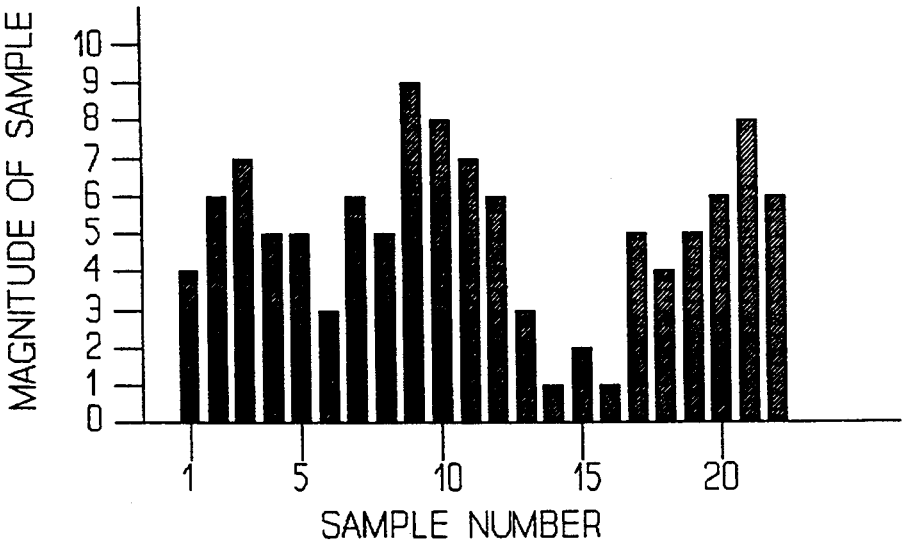
FIG. 4 is a graph exemplifying 22 monaural sound samples used by the method.

FIG. 4 depicts 22 monaural sound samples stored in memory 24. In this example it is assumed that the samples of FIG. 4 are the middle of the segment being processed. The numbers assigned to the sample numbers are for convenience.

Table 3 demonstrates the generation of output value of the sound samples where the ratio to the center of the head is equal to 1.25. The summation ratio (SUM RATIO) illustrates the addition of the ratio 1.25 being added to the fractional portion of the preceding summation ratio. It is assumed that the value of the fractional portion of the preceding summation ratio prior to the start of this example was 0. The table further shows the monaural sample values used and the output value for the sound sample after interpolation.

Figure 5:
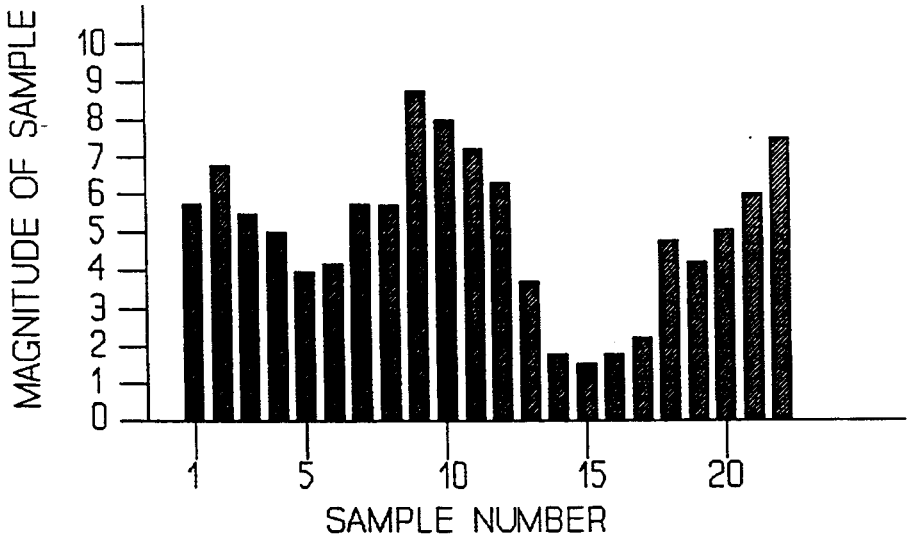
FIG. 5 is a graph showing the sound samples generated by the method using the ratio of 1.25 with reference to the center of the head.

FIG. 5 is a graph of the output values of Table 3. It should be understood that at the start of this example FIFO 25 would have included samples 1 and 2 within that FIFO and, therefore, in FIG. 4, samples 1 and 2 have already been read from memory 24. The next value that would be read from memory 24 would be sample 3. At the end of the example, sample 22 has been read from the memory store and is stored in FIFO 25.

It therefore can readily be realized by comparing FIG. 4 with FIG. 3 that samples 3 through 22 of FIG. 4 have now been compressed into the 16 sound samples of FIG. 5.

Figure 6:
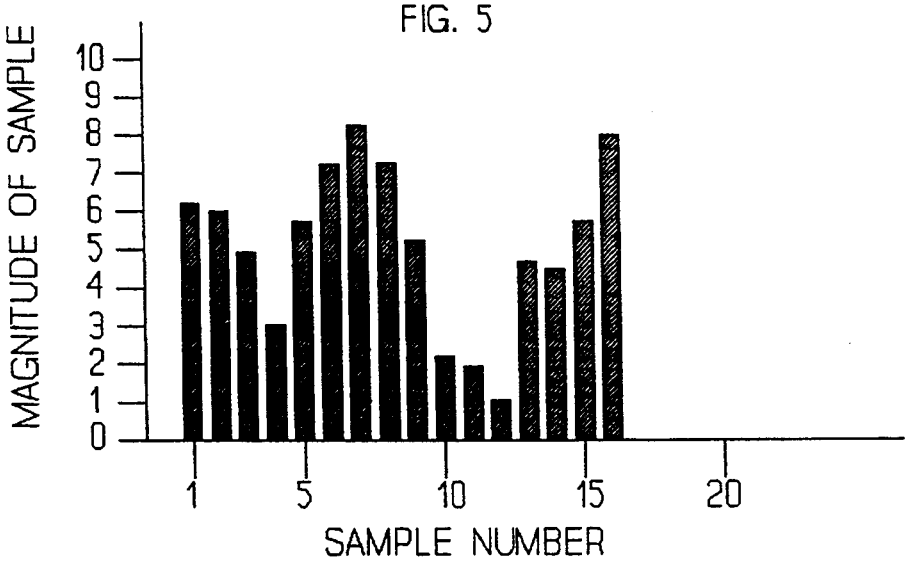
FIG. 6 is a graph showing the sound samples generated by the method using the ratio of 0.9 with reference to the center of the head.

Table 4 is another example for the generation of sound samples in accordance with the method. Table 4 assumes the ratio $R_R$ to be 0.9, that is the object is moving away from the listener rather than toward the listener. FIG. 6 illustrates the sound samples generated by the method from the monaural sound samples of FIG. 4. Again, sound samples 1 and 2 of FIG. 4 were stored in FIFO 25 at the start of the example and it was assumed that the fractional portion D of the resulting summation ratio was equal to 0 at the start of the example. Table 4 indicates that for the first cycle of operation the integer portion of the summation ratio is 0, thus no new samples will be extracted from memory 24 and the existing values of samples 1 and 2 in FIFO 25 will be used. Since the fractional portion of the summation ratio is 0.9, the interpolation will be performed generating an output value of 5.80. Comparing FIG. 6 with FIG. 4 shows that sound samples 3 through 22 of FIG. 4 have been expanded or stretched out to give generated sound samples 1 through 22 of FIG. 6.

TABLE 3

| SAMPLE | | SUM | Ratio = 1.25 SAMPLE | | | CYCLE |
|---|---|---|---|---|---|---|
| NUMBER | VALUE | RATIO | VALUES | USED | OUTPUT VALUE | NUMBER |
| 1 | 4 | | | | | |
| 2 | 6 | 1.25 | 6 | 7 | 6.25 | 1 |
| 3 | 7 | 1.50 | 7 | 5 | 6.00 | 2 |
| 4 | 5 | 1.75 | 5 | 5 | 5.00 | 3 |
| 5 | 5 | 2.00 | 3 | 6 | 3.00 | 4 |
| 6 | 3 | 1.25 | 6 | 5 | 5.75 | 5 |
| 7 | 6 | 1.50 | 5 | 9 | 7.00 | 6 |
| 8 | 5 | 1.75 | 9 | 8 | 8.25 | 7 |
| 9 | 9 | 2.00 | 7 | 6 | 7.00 | 8 |
| 10 | 8 | 1.25 | 6 | 3 | 5.25 | 9 |
| 11 | 7 | 1.50 | 3 | 1 | 2.00 | 10 |
| 12 | 6 | 1.75 | 1 | 2 | 1.75 | 11 |
| 13 | 3 | 2.00 | 1 | 5 | 1.00 | 12 |
| 14 | 1 | 1.25 | 5 | 4 | 4.75 | 13 |
| 15 | 2 | 1.50 | 4 | 5 | 4.50 | 14 |
| 16 | 1 | 1.75 | 5 | 6 | 5.75 | 15 |
| 17 | 5 | 2.00 | 8 | 6 | 8.00 | 16 |
| 18 | 4 | | | | | 17 |
| 19 | 5 | | | | | 18 |
| 20 | 6 | | | | | 19 |
| 21 | 8 | | | | | 20 |
| 22 | 6 | | | | | 21 |
| | | | | | | 22 |
| | | | | | | 23 |

TABLE 4

| SAMPLE NUMBER | SAMPLE VALUE | SUM RATIO | Ratio = 0.9 SAMPLE VALUES | Ratio = 0.9 SAMPLE USED | OUTPUT VALUE | CYCLE NUMBER |
|---|---|---|---|---|---|---|
| 1 | 4 | | | | | |
| 2 | 6 | 0.90 | 4 | 6 | 5.80 | 1 |
| 3 | 7 | 1.80 | 6 | 7 | 6.80 | 2 |
| 4 | 5 | 1.70 | 7 | 5 | 5.60 | 3 |
| 5 | 5 | 1.60 | 5 | 5 | 5.00 | 4 |
| 6 | 3 | 1.50 | 5 | 3 | 4.00 | 5 |
| 7 | 6 | 1.40 | 3 | 6 | 4.20 | 6 |
| 8 | 5 | 1.30 | 6 | 5 | 5.70 | 7 |
| 9 | 9 | 1.20 | 5 | 9 | 5.80 | 8 |
| 10 | 8 | 1.10 | 9 | 8 | 8.90 | 9 |
| 11 | 7 | 1.00 | 8 | 7 | 8.00 | 10 |
| 12 | 6 | 0.90 | 8 | 7 | 7.10 | 11 |
| 13 | 3 | 1.80 | 7 | 6 | 6.20 | 12 |
| 14 | 1 | 1.70 | 6 | 3 | 3.90 | 13 |
| 15 | 2 | 1.60 | 3 | 1 | 1.80 | 14 |
| 16 | 1 | 1.50 | 1 | 2 | 1.50 | 15 |
| 17 | 5 | 1.40 | 2 | 1 | 1.60 | 16 |
| 18 | 4 | 1.30 | 1 | 5 | 2.20 | 17 |
| 19 | 5 | 1.20 | 5 | 4 | 4.80 | 18 |
| 20 | 6 | 1.10 | 4 | 5 | 4.10 | 19 |
| 21 | 8 | 1.00 | 5 | 6 | 5.00 | 20 |
| 22 | 6 | 0.90 | 5 | 6 | 5.90 | 21 |
| | | 1.80 | 6 | 8 | 7.60 | 22 |
| | | 1.70 | 8 | 6 | 6.60 | 23 |

Figure 7:
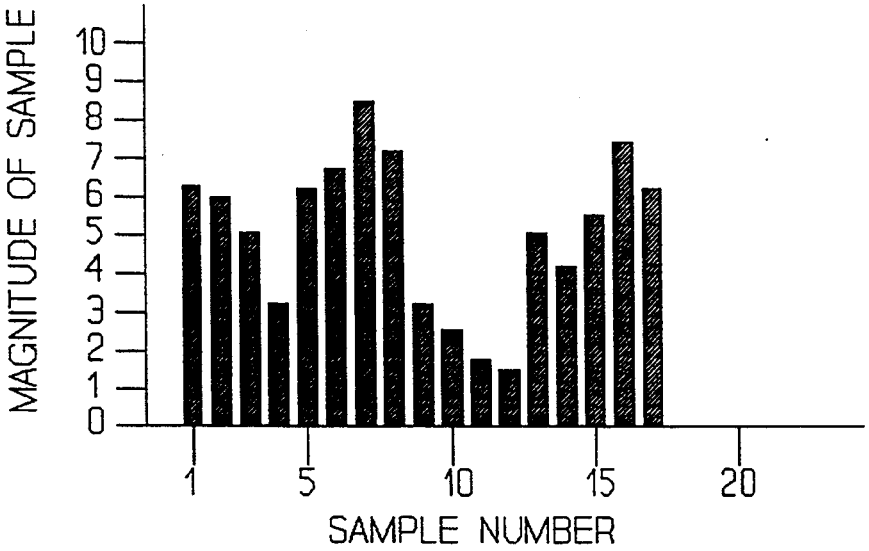
FIG. 7 is a graph showing the sound samples generated by the method for the off ear using the ratio of 1.23.
Figure 8:
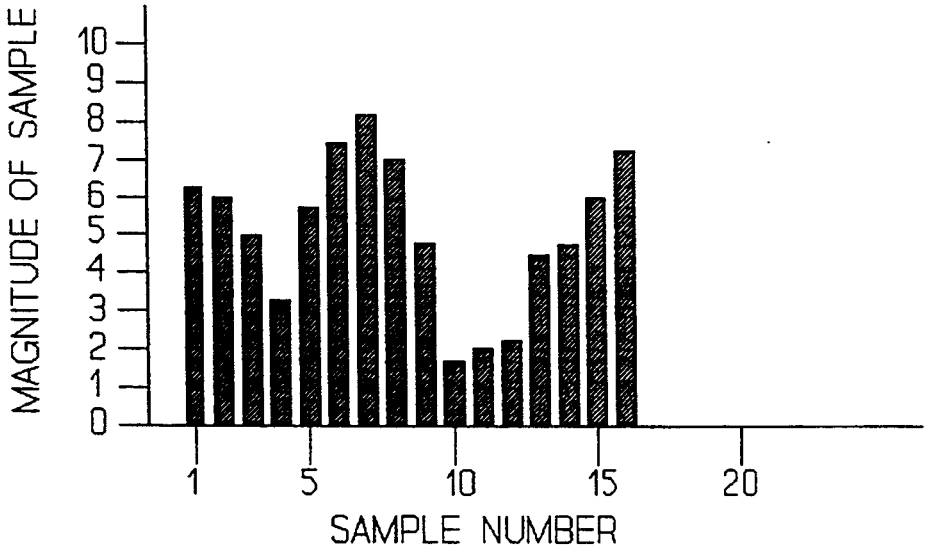
FIG. 8 is a graph showing the sound samples generated by the method for the near ear using the ratio of 1.27.

The previous discussion has used the ratio to the center of the head where the method uses the ratio which has been corrected to the right and left ear. FIGS. 7 and 8 depict the resulting sound samples if we allowed the correction to the ratio for the center of the head to be +/−0.02. Again this is being used for exemplary purposes only and it is anticipated that the differences between the right and left ear will not be of the magnitude of 0.02. However, for exemplary purposes, FIGS. 7 and 8 show the results of the method as previously described for the near ear and for the off ear. FIGS. 7 and 8 can be compared with FIG. 5. For the near ear (FIG. 7) the number of ticks generated are the same but the magnitude of each of the ticks are different. With regard to the off ear (FIG. 8) one additional tick was necessary for the method than for the near ear. Again, each of the ticks are of a different magnitude than that for the center of the head. Thus, the near and the off ear will have a different set of generated sound samples for the same segment.

Reverberation Portion

Figure 9:
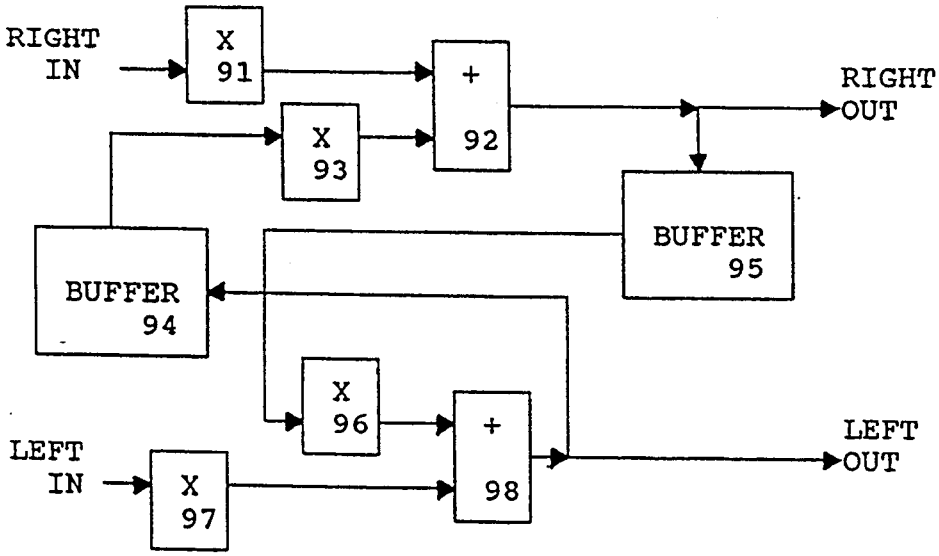
FIG. 9 is a logic diagram depicting the method practiced by the invention for introducing reverberation for both ears.

It is desirable to add reverberation to the generated sound since it is desired to emulate sound in three dimensional space. FIG. 9 logically depicts the method for introducing reverberation. The generated sound sample for the right ear is first multiplied by multiplier 91 and then added together with the output of multiplier 93. The values of the multiplication factors for multipliers 91 and 93 when added together are equal to 1. The input to multiplier 93 is the output of the reverberation buffer 94. The reverberation buffers 93 and 94 are analogous to a FIFO buffer where the oldest sample stored in the buffer is the sample that will next be multiplied by multiplier 93 and added by adder 92 to the output of multiplier 91. The input of reverberation buffer 94 is the output of adder 98 which is the adder associated for the left ear. Thus there is cross-coupling between the two ears in the reverberation section of the method. It has been found that reverberation buffers 94 and 95 should be of different lengths. In the present embodiment reverberation buffer 94 is 2,039 ticks and reverberation buffer 95 is 1,777. This delay equates to a 46 and 40 millisecond delay respectively for buffers 94 and 95.

The upper limit of the multiplication factor for the multiplier 96 and 93 is 0.5. In the present embodiment of the invention the maximum reverberation level is set to 100 units on a scale of 256 units, or a decimal value of 0.391. It has further been found that it is desirable to not only have the delay for each ear different but also the amount of reverberation should be different for each ear. To this end, the method calls for a 5% reduction in the reverberation level between the two ears.

Figure 15:
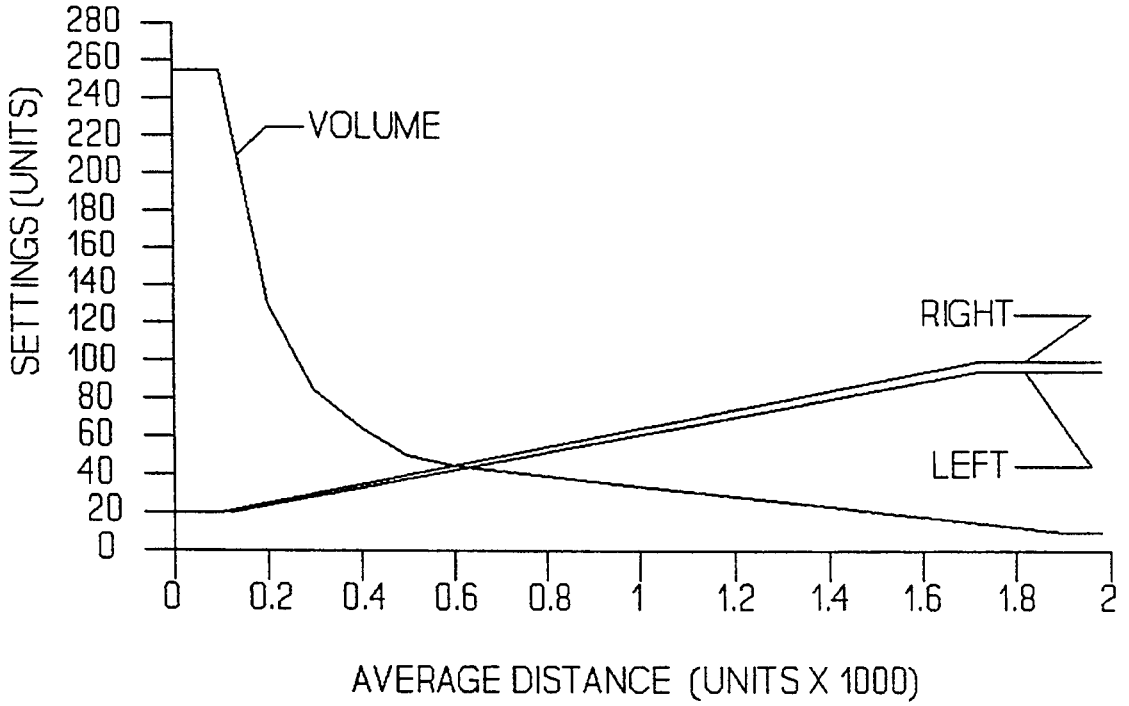
FIG. 15 is a graph depicting the relationship of the volume adjust multiplier as a function of average distance and the relationship of the left and right ear reverberation multipliers as a function of distance in accordance with the methods described.

Reverberation is a function of distance from the listener to the object that would be generating the sound. The greater the distance the greater the reverberation for a given set of reverberation characteristics. It is desirable to have some reverberation in all cases and, therefore, a minimum reverberation level is set to 20 on a scale of 256 or 0.078. FIG. 15 is a graph which shows the reverberation levels settings for the two ears as a function of distance- It has been found convenient in this method to use a scaling factor of 256 for calculating the various values of multiplied functions used throughout the method. For example, if the right ear reverberation level for a given distance was determined to be 50 units, then the reverberation level for the left ear would be 5% less, or 47.5 units. The multiplication factor associated with the multiplication function as illustrated by multiplier number 93 would be 0.195. This would cause the setting of multiplier 91 to be equal to 0.805 in that the multiplication factors for the multiplication steps illustrated by multipliers 90 and 91 must equal 1. The multiplier factors for the left ear would be set slightly different in that multiplier factor associated with multiplier 96 is set at a value of 95% of the multiplication factor represented by multiplier 93. The resulting value of the multiplication factor associated with the multiplier 96 would be 0.185, which in turn would cause the multiplication factor associated with multiplier 97 to be 0.815. Again, the summation of the multiplication factors associated with multipliers 96 and 97 must equal 1.

The method defines the reverberation level to equal the MINIMUM REVERBERATION plus the sum of the average distance $d_m$ minus the NEARBY value divided by the REVERBERATION STEPS. The MINIMUM REVERBERATION is 20, NEARBY is 100 units of distance, REVERBERATION STEP is 10 and MAXIMUM REVERBERATION is 100. Therefore the settings of the reverberation multiplication factor is a function of the distance between the listener and the object, taking into account maximum and minimum reverberation values allowed. The user of the system is given the prerogative of setting the values for MAXIMUM REVERBERATION level, MINIMUM REVERBERATION, NEARBY and REVERBERATION STEP. In this means the user has the freedom to control the reverberation characteristics which the user wishes to have associated with the sound being generated. The user can, by adjusting these values, have the reverberation sound like the object and listener are in a tunnel or in a deadened sound-proof room.

Frequency Shaping

It is known that a sound generated in three dimensional space has its frequency components filtered by the media through which it is travelling such that the sound heard by the listener has the frequency components of the original sound substantially altered. Besides the doppler effect, as previously addressed, there are other well known phenomena that affect the frequency component of the sound and act as location queues for the listener.

The first phenomenon is the greater the distance sound has to travel, the greater the high frequency components of the sound are attenuated. A second phenomenon is that of head shadowing of the sound where low frequencies easily go around the head while the high frequencies are blocked or attenuated.

Another phenomenon is the sensitivity peak for the normal ear in the range of 7–8 kHz. Since it is envisioned that the listener will be wearing earphones, all sound will be subject to this phenomenon. It has been understood that the effects of this phenomenon is a function of the location of the object making the sound with respect to the listener such that it is maximum when the object making the sound is perpendicular to an ear of the listener and minimum when the object making the sound is in front or behind the listener. Since earphones are used any sound queue with regard to this phenomenon that would have been attainable are destroyed because the earphones are directly perpendicular to the listener's ear. Therefore the method adjusts for this phenomenon by having a notch filter at 7–8 kHz where the depth of the notch is a function of the object's location relative to the listener. When the object is perpendicular to the listener's ear then the notch of the notch filter is approximately 0, leaving the phenomenon to exist in its natural state. As the object is located around the listener's head, the depth of the notch of 7–8 kHz is increased to a maximum level of 5 db when the object is either directly in front of or to the rear of the listener. By this method the sound queues associated with the phenomenon are again provided to the listener.

To this end, a combination of a notch and low pass digital filter has been employed. Digital filters are commonly known and a discussion of them will not be provided herein. A reference for digital filters is the text entitled "Digital Audio Signal Processing by John Strawm, published by William Kaufman, Inc., 1985, ISBN 0-86576-0H2-9.

Figure 10:
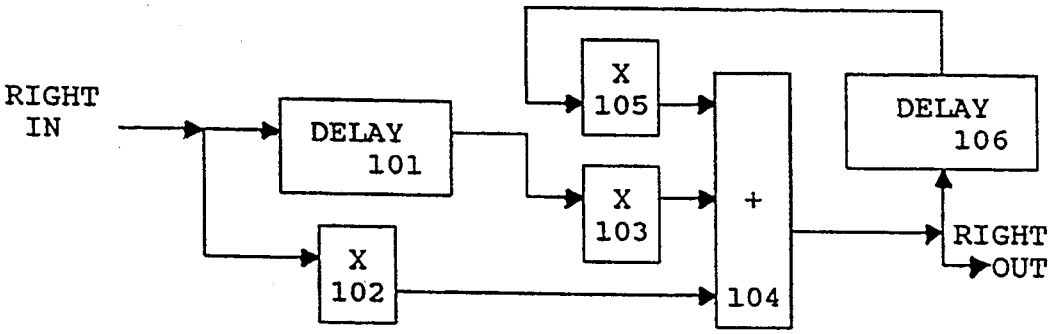
FIG. 10 is a logic drawing depicting the combination notch filter and low pass filter used for providing waveshaping.

FIG. 10 is a logic illustration of the combined digital notch and low pass filters used for waveshaping for location queueing. The notch filter is comprised of a three sample delay 101, two multipliers, 102 and 103, and adder 104. The low pass filter is shown as a one sample delay 106 and multiplier 105. The output of multiplier 105 is added to the output of multipliers 103 and 102 by adder 104. In determining the multiplication factor associated with multipliers 102, 103 and 104, methodology has been established to emulate the frequency shaping that is provided in the natural environment for sound generated in three dimensional space.

To this end a first value (beta) is generated. A value for beta is calculated for the right and for the left ear as follows:

$$\text{Beta left ear} = ((d_m - \text{NEARBY})\ 100) + 10|\sin\phi_m| \text{ (if } \phi_m \text{ is in the range of 90° to 180°)} + 10|\sin\phi_m| \text{ (if } \phi_m \text{ is in the range of 0° to 180°)}$$

$$\text{Beta right ear} = ((d_m - \text{NEARBY})\ 100 + 10|\sin\phi_m| \text{ (if } \phi_m \text{ is in the range of 90° to 180°)} + 10|\sin\phi_m| \text{ (if } \phi_m \text{ is in the range of 180° to 360°)}$$

Beta is used to account for distance roll-off, rear head and side head shadowing.

A second value (alpha) is calculated for each ear as follows:

$$\textit{Alpha left ear} = \textit{Beta left ear}\ 2 + 5|\cos\phi_m| - 2.5$$

$$\textit{Alpha right ear} = \textit{Beta right ear}\ 2 + 5|\cos\phi_m| - 2.5$$

It has been found that the combination of the notch filter with the low pass filter provides the best results with regard to the desired frequency shaping. Alpha values depend on the beta values thereby allowing flatter and lower knee of the high frequency roll-off characteristics of the filters. The term $5|\cos\phi_m|$ controls the notch of the notch filter as a function of the position of the object and limits the notch to be 5 decibels.

Most earphones have designed compensation for the frequency at 7–8 kHz. A factor of −2.5 db has been included to offset this design characteristic of the earphone such that the listener receives truer sound queues. The value of alpha and beta are in decibels and it is necessary to convert those values into multiplication factors for the various multiplication functions to be performed within the digital filters. A scale of 256 has again been used and by experimentation the following tables have been generated.

As can be seen from Table 6, the maximum decibel level that would be allowed in the alpha table is 20 db and, therefore, if the value of alpha should be greater than 20, it would be limited to the value for 20 db. In a similar fashion Table 7 shows that if the value of beta should be greater than 9 db, the value will be limited to 9 db. Where the resulting decibel values of alpha and beta are not whole integers, alpha and beta is obtained by interpolation. The results of the interpolation are always rounded to the nearest whole number.

Because the filters used were combined the alpha value must be adjusted. The alpha value is mapped into the remaining scale units not used by beta such that alpha will have the same percentage of the remaining units that it had in the original scale. The value of alpha is obtained as follows:

$$\textit{Alpha(new)} = (256 - \textit{Beta}) \times (\textit{Alpha(old)}/256)$$

TABLE 6

| Alpha Table | | | |
|---|---|---|---|
| Decibel | Scale Value | Decibel | Scale Value |
| 0 | 0 | 11 | 92 |
| 1 | 15 | 12 | 96 |
| 2 | 27 | 13 | 102 |
| 3 | 38 | 14 | 103 |
| 4 | 48 | 15 | 105 |
| 5 | 56 | 16 | 107 |
| 6 | 64 | 17 | 110 |
| 7 | 72 | 18 | 112 |
| 8 | 77 | 19 | 113 |
| 9 | 82 | 20 | 115 |
| 10 | 88 | | |

TABLE 7

| Beta Table | |
|---|---|
| Decibel | Scale Value |
| 0 | 0 |
| 1 | 15 |
| 2 | 30 |
| 3 | 46 |
| 4 | 59 |
| 5 | 73 |
| 6 | 87 |

TABLE 7-continued

| Beta Table | |
|---|---|
| Decibel | Scale Value |
| 7 | 102 |
| 8 | 112 |
| 9 | 127 |

Let us assume for the sake of example that beta equaled 3 db for a scale value of 46, and alpha equaled 9 db for a scale value of 82. In the example given, alpha (new) would become 67. The beta value is used to set the multiplication factor associated with multiplier 105 and in this given example would be 0.180. The alpha value of 67 would be used to create the multiplication factor associated with multiplier 103 which in our example would be 0.262. It is required that the multiplier functions of multipliers 102, 103 and 105 equal one or unity and, therefore, multiplier 102's value would be 0.558.

Figure 14:
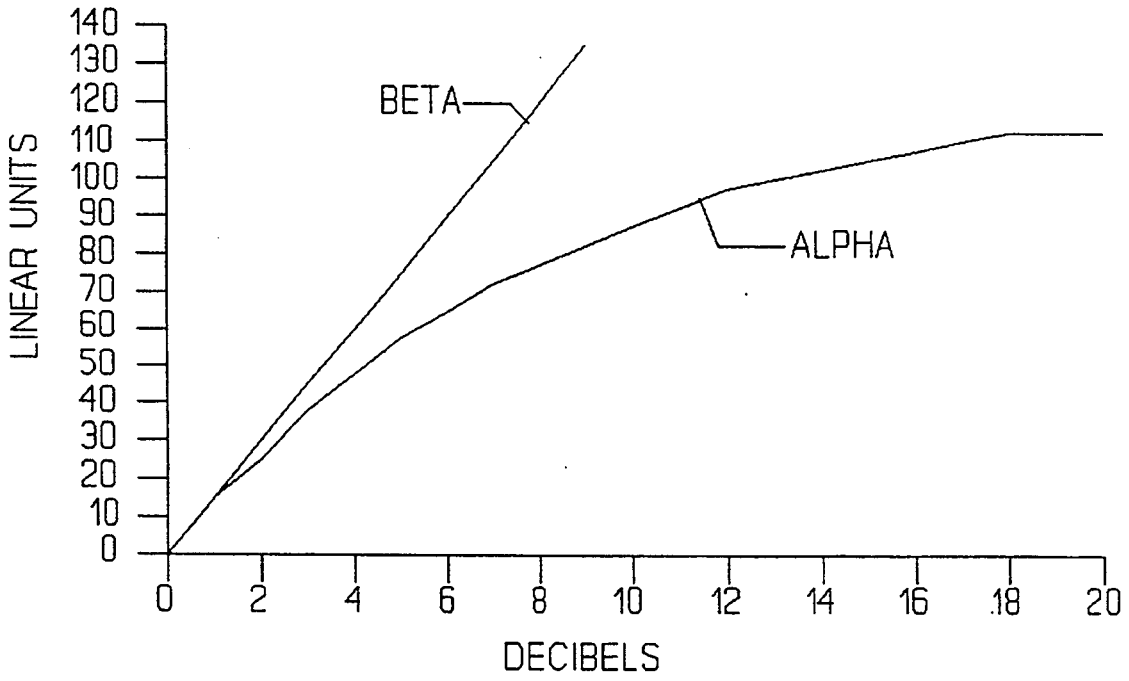
FIG. 14 is a graph depicting the conversion tables for alpha and beta from decibels to units.

FIG. 14 is a plot of the conversion scale of Tables 6 and 7 for alpha and beta.

Figure 12:
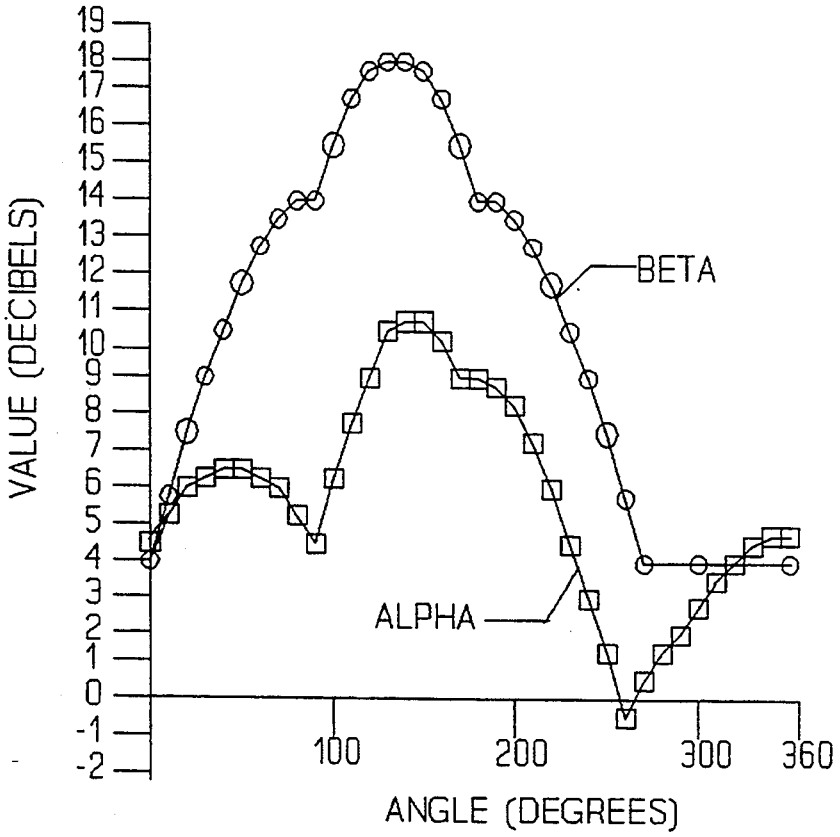
FIG. 12 is a graph depicting alpha and beta values for the left ear as a function of the angle of the object at an average distance of 500 units.
Figure 13:
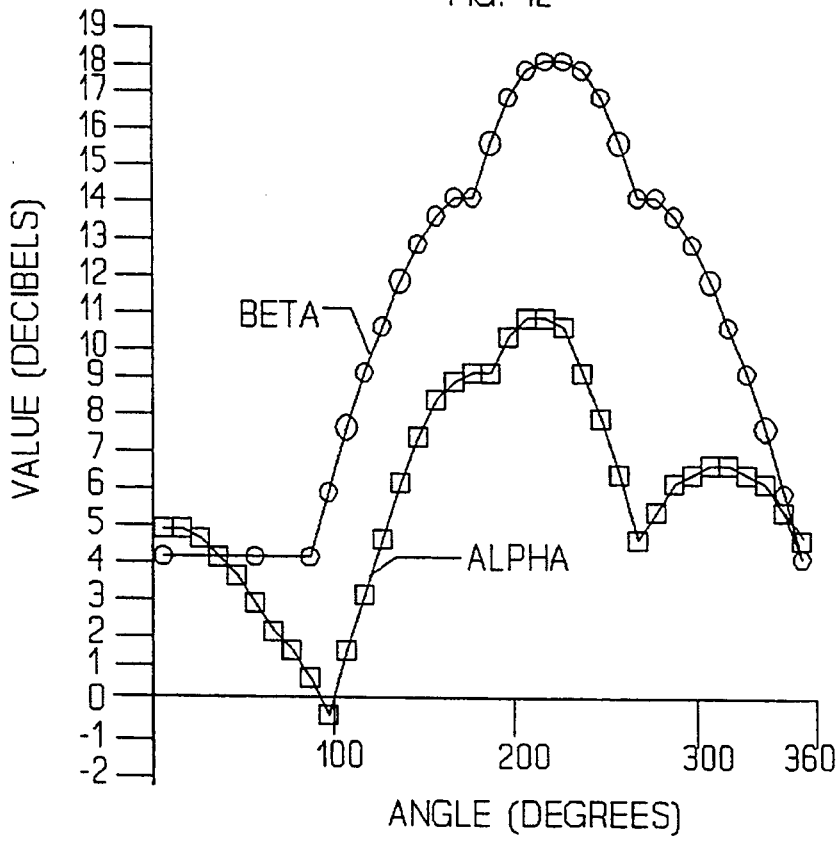
FIG. 13 is a graph depicting alpha and beta values for the right ear as a function of the angle of the object at an average distance of 500 units.

FIG. 12 is a graph showing the values for alpha and beta in decibels as a function of the average angle $\phi_m$ for a constant average distance $d_m$, of 500 units for the left ear. FIG. 13 shows the value of the alpha and beta in decibels as a function of the average angle $\phi_m$ for a constant average distance $d_m$ of 500 units for the right ear. As can readily be seen by FIGS. 12 and 13, the resulting values for the alpha and beta for the right and left ear will be different for the same average distance $d_m$ for the sum average angle $\phi_m$.

Each of the generated samples, after being altered for reverberation, are processed through the digital filters using the values for the multiplication functions as herein described. The output of the filters is a filtered sound sample.

Volume Adjust Portion

The filtered sound sample is then adjusted in volume to account for the distance between the listener and the object as well as for the relative strength of the original sound.

Figure 11:
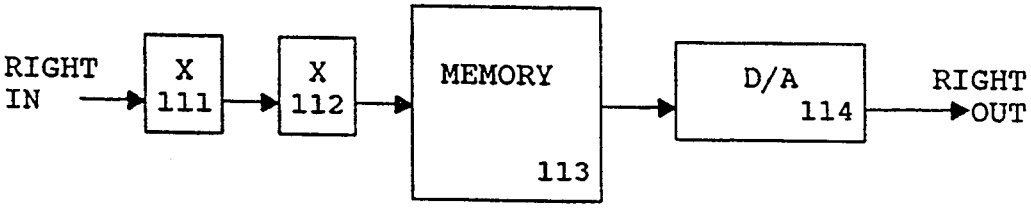
FIG. 11 is a logic diagram depicting the function of volume adjustment as a function of distance, the relative loudness of the sound to be generated and the storage of the final digital sound sample in memory which is connected to a digital to analog converter to provide an analog output for each ear.

FIG. 11 is a logic diagram illustrating the method of the invention. The digital sound sample is first multiplied by multiplier 111. Multiplier 111's multiplication factor is determined as a function of the distance from the listener to the object. Once again a scale from 0–256 is used. The equation for adjusting the volume is:

$$Volume=(256\times NEARBY)d_m$$

If the mid or average distance $d_m$ is less than NEARBY then the volume is full at 256. It is desirable to have the volume always set at some value greater than zero and, therefore, a minimum setting for the volume is VERY QUIET which has a value of two.

FIG. 15 is a graph which depicts the volume settling as a function of distance in units. For example, if the average distance $d_m$ was 1,000 units (100 meters), the resulting volume adjust level would be 25.6. When converted to a decimal value the resulting multiplication factor would be 0.1.

The output of multiplier 111 is then multiplied by multiplier 112. The multiplier factor associated with multiplier 112 is set by the user and determines the relative loudness or strength of the sound for the various sounds being generated by the method.

It is anticipated that more than one sound will be generated at the same time. This can be done by parallel processing of the sound or sequential processing of the sounds where the computing machine is fast enough to generate the digital samples for each of the sounds for each of the ears during the period of one tick.

The output of the multiplier 112 or the multiplication function associated therewith is then stored in a memory 113. The digital sound samples are taken from memory 113 at the rate of 44.1 kHz. The output of the memory 113 is in turn sent to a digital-to-analog converter 114. The output of digital analog converter 114 will be an analog signal which when processed by earphones will generate sound where the sound will be representative of the sound that would have been generated by the object as that object moves from $P_1$ to $P_2$. Again, it is understood that there is a channel for generating and processing sound samples for each ear and that the resulting analog signal for each ear will be different.

A fully computerize implementation of the invention as described heretofore uses known digital software implementations. A program written in programming language C is provided in Appendix A. This program practices the method of the invention consisting of the five portions as set forth above.

While the preferred embodiment of the invention as described herein included five portions, it should be understood that the segment determination portion, reverberation portion, frequency shaping portion, and the volume adjust portion may be deleted. The omission of one or more of these portions will effectively lose some sound queues as to the location of the object and will decrease the quality of the sound produced.

A specific embodiment of the sound generation method has been described for the purpose of illustrating the manner in which the invention may be practiced. It should be understood that implementation of the other variations and modifications of the invention in its various aspects will be apparent to those skilled in the art and that the invention is not limited thereto by the specific embodiment described. The present invention is therefore contemplated to cover any and all modifications, variations and equivalents that fall within the true spirit and scope of the underlying principles disclosed and claimed herein.

```
*****************************************************
*                                                   *
* Copyright © 1992 The 3DO Company                  *
*                                                   *
*                                                   *
*                                                   *
* 33D sound processing routine.  Two channels       *
*                                                   *
* Register twiddling set up for 4/8/4 mapping.      *
* Odd-numbered RBASE landrumizations not used       *
*****************************************************
```

```
*****************************************************
*                                                   *
* RBASE R0-R3   R4-R7   R8-R11
*   0   0-3     104-107 200-203         General input/control          *
*   2   8-B     10C-10F 208-20B         Left ear, doppler/picker           *
*   4   10-13   114-117 210-213         Left ear, filter               *
*   6   18-1B   11C-11F 218-21B         Right ear, doppler/picker      *
*   8   20-23   124-127 220-223         Right ear, filter              *
*   A   28-2B   12C-12F 228-22B         Final volume/mixing for both ears *
*                                                   *
*****************************************************

RBASE_GENERAL           EQU     $0
RBASE_LEFT_DOPPLER      EQU     $2
RBASE_LEFT_FILTER       EQU     $4
RBASE_RIGHT_DOPPLER     EQU     $6
RBASE_RIGHT_FILTER      EQU     $8
RBASE_MIX               EQU     $A

*****************************************************
*                                                   *
* INPUT-FIFO                    Purpose                     *
*                                                   *
* F0                            Left ear, raw sounds            *
* F1                            Right ear, raw sounds           *
* F2                            Left ear, reverb input          *
* F3                            Right ear, reverb input         *
*                                                   *
*****************************************************

LEFT_RAW_IN             EQU     $F0
RIGHT_RAW_IN            EQU     $F1
LEFT_REVERB_IN          EQU     $F2
RIGHT_REVERB_IN         EQU     $F3

*****************************************************************
*                                                               *
* Working-memory locations, normally mapped into filters' R11   *
* space, which are accessed directly during final mixing        *
*                                                               *
*****************************************************************/

LEFT_OUT                EQU     $213
RIGHT_OUT               EQU     $223

*****************************************************
*                                                   *
* OUTPUT-FIFO                   Purpose                     *
*                                                   *
* 330                           Left ear, reverb output         *
* 331                           Right ear, reverb output        *
* 332                           Left ear, final sound           *
* 333                           Right ear, final sound          *
*                                                   *
*****************************************************

LEFT_REVERB_OUT         EQU     $3F0
RIGHT_REVERB_OUT        EQU     $3F1
LEFT_DAC_OUT            EQU     $3F2
RIGHT_DAC_OUT           EQU     $3F3

/*********************************************
*                                           *
* RBASE=0 register allocation               *
*                                           *
* R0    DSPP clock, memory mapped           *
* R1    unused      *
* R2    unused                              *
* R3    unused                              *
```

```
* R4     -- 0 if first time, -- 1 otherwise          *
*                                                    *
*****************************************************/

*****************************************************
*                                                    *
* RBASE=RBASE_MIX register allocations for final mix *
*                                                    *
* R0     left-DAC volume for 33D left ear sound      *
* R1     left-DAC volume for 33D right ear sound     *
* R2     right-DAC volume for 33D right ear sound    *
* R3     right-DAC volume for 33D left ear sound     *
*                                                    *
*****************************************************/
        PAGE
* Main routine.

START:  R4
*       SYNC
        BNE     NOT1ST

*
* Initial program bootstrap.  Walk through the sound channels' register
* banks, and preinitialize the working registers with whatever's necessary.
*
        MOVE    R4<-#1
        RBASE   RBASE_LEFT_DOPPLER
        JSR     ZEROWRK
        MOVE    R8<-#LEFT_RAW_IN
        MOVE    R9<-#LEFT_REVERB_IN
        RBASE   RBASE_LEFT_FILTER
        JSR     ZEROWRK
        NOP                     ; keep following RBASE from executing
        RBASE   RBASE_RIGHT_DOPPLER
        JSR     ZEROWRK
        MOVE    R8<-#RIGHT_RAW_IN
        MOVE    R9<-#RIGHT_REVERB_IN
        RBASE   RBASE_RIGHT_FILTER
        JSR     ZEROWRK
        NOP                     ; wait for it...
        SLEEP
*
* Subroutine to zero out all working registers
*

ZEROWRK MOVE    R4<-#0
        MOVE    R5<-#0
        MOVE    R6<-#0
        MOVE    R7<-#0
        MOVE    R8<-#0
        MOVE    R9<-#0
        MOVE    R10<-#0
        MOVE    R11<-#0
        RTS
        NOP
        PAGE
```

---

```
*
*       Up and running.
*

NOT1ST:
        RBASE   RBASE_LEFT_DOPPLER      ; Doppler/interpolate left ear
        JSR     INTERP
        NOP
        LEFT_REVERB_OUT=A               ; write accume to reverb out FIFO
        RBASE   RBASE_LEFT_FILTER
        JSR     FILTER                  ; filter it
        NOP                             ; wait for it
        RBASE   RBASE_RIGHT_DOPPLER     ; Doppler/interpolate right ear
        JSR     INTERP
        NOP
        RIGHT_REVERB_OUT=A              ; write accume to reverb out FIFO
        RBASE   RBASE_RIGHT_FILTER
        JSR     FILTER                  ; filter it
        NOP                             ; wait for it
        RBASE   RBASE_MIX               ; prepare to mix
        R0*LEFT_OUT                     ; mult left ear sound, left DAC
        LEFT_DAC_OUT=R1*RIGHT_OUT+A     ; mult/mix right ear sound, left DAC
        R2*RIGHT_OUT                    ; mult right ear sound, right DAC
        RIGHT_DAC_OUT=R3*LEFT_OUT+A     ; mult/mix left ear sound, right DAC
        SLEEP                           ; done
```

```
*****************************************************
*                                                   *
* Phase 1 - handle Doppler sampling and reverb processing *
*           with linear interpolation during sample *
*           skipping and doubling.                  *
*                                                   *
* Input registers:                                  *
*                                                   *
*       R0      reverb level                        *
*       R1      nonreverb level (1.0 - reverb level) *
*       R2      Doppler pick rate, integer portion  *
*       R3      Doppler pick rate, fractional portion *
*                                                   *
* Work registers:                                   *
*                                                   *
*       R4      Doppler sample time, integer, high part *
*       R5      Doppler sample time, integer, low part *
*       R6      Doppler sample offset, integer      *
*       R7      Doppler sample offset, fractional   *
*       R8      input-sample DMA pointer            *
*       R9      reverb-input DMA pointer            *
*       R10     "this" sample from input            *
*       R11     "prev" sample from input            *
*                                                   *
* Output registers:                                 *
*                                                   *
*       None used.                                  *
*                                                   *
* Memory outputs:                                   *
*                                                   *
*       Dopplered and reverbed sample returned in ALU accume. *
*       Hasn't yet been written to reverb-output DMA. *
*                                                   *
*****************************************************/

INTERP:
        NOP
        NOP
        NOP
*       Add R3 to R7, write result back to R7   ! fractional part of doppler
        @R7+R3
*       Add carry bit to R2, write to R6        ! real part of doppler
        R6=R2+C
*       Add result to R5, write back to R5              ! update time/low
        @R5+A
*       Add carry to R4, write back to R4       !  update time/high
        @R4+C
*       Subtract 1 from R6, >> 4 arith          ! see if it rolled over
        R6-#1>>>'4
*       Branch if negative to LININT            ! quit if not
        BMI LININT
*       Sanity buffer
        NOP

DOPPL2:
*       Decrement accume, 20 bit                !  see if need to skip later
        —A
*       Move R10 to R11                         ! propagate
        MOVE R11<-R10
*       Move (R8) to R10                        ! fetch a sample
        MOVE R10<-[R8]
*       Branch back if need to skip this sample
        BGE DOPPL2

LININT:
*       ALU xfer R7 >> 1, write to R6           ! convert to pos fraction
        R6=R7>>'1
*       ALU add 0x8000 to accume            !  calc F - 1.0
        A+#$8000
*       Mult accume * R11, ALU pass             !   prev*(F-1)
        A*R11
*       Mult R6*R10, subtract accume            !    this*F + prev*(1-F)
        R6*R10-A

REVERB2:
*       Multiply accume * R1, pass through ALU  ! Weight the interp sample
        R1*A
*       Multiply (R9) * R0, add, return in ALU  !  Weight reverb, update bfr
```

```
*       Return                                  # Done
        RTS
        PAGE
*****************************************
*                                       *
* Phase 2 - handle filtering and mixing *
* ------------------------------------ *
*                                       *
* Input registers:                      *
*                                       *
*       R0      alpha level (1-sample feedback)   *
*       R1      beta level (3-sample feedforward)  *
*       R2      feed level (1 - |alpha| - |beta|)  *
*       R3      unused                            *
*                                       *
* Work registers:                       *
*                                       *
*       R4      feedforward 1                     *
*       R5      feedforward 2                     *
*       R6      feedforward 3                     *
*       R7      feedback                          *
*       R8      unused                            *
*       R9      unused                            *
*       R10     input sample                      *
*       R11     output sample                     *
*                                       *
* Output registers:                     *
*                                                 *
*       none                                      *
*                                                 *
*****************************************/

FILTER:

*       Move accume to R10                      # save input
        R10=A
*       Multiply accume * R2, ALU passthrough   # weight input
        R2*A
*       Multiply R0 * R7, ALU add               #  weight alpha feedback
        R0*R7+A
*       Multiply R1 * R6, ALU add, write R11    #
        R11=R1*R6+A
*       Move R5 to R6                           # advance feedforward
        MOVE R6<-R5
*       Move R4 to R5                           #  advance feedforward
        MOVE R5<-R4
*       Move R10 to R4                          #   advance feedforward
        MOVE R4<-R10
*       Move R11 to R7                          # feed it back
        MOVE R7<-R11
*       Return                                  # done
        RTS
        NOP
        END
#define SAMPLESPERSEC 44100L
#define SECONDS 1
#define BASEFREQ 60

#define MAXALPHACOUNT 5
#define MAXALPHA 127
#define MAXBETA 127
#define MAXDELTA 25
#define MAXVOLUME 255

/* MAXREVERBTIME must be a power of 2, minus 1! */

#define MAXREVERBTIME 2047
#define MAXREVERBLEVEL 100

/*
    SAMPLESPERUNIT defines the number of sound samples per measuring unit
    (currently 14 samples per decimeter unit... this misestimates the speed
    of sound by about 4%).
*/
```

```
#define SAMPLESPERUNIT 14

/*
    A sound source located within NEARBY units of the observer will be heard at
    full volume.  If further away than NEARBY, the volume will be reduced in
    proportion to the distance.  Minimum volume is set by VERYQUIET.
*/

#define NEARBY 100
#define VERYQUIET 2

/*
    A sound source located within NEARBY units of the observer will have a
    reverberation level of MINREVERB.  If further away than NEARBY, the
    reverb level will be increased to a maximum of MAXREVERBLEVEL, with an
    increase of one reverb unit per REVERBSTEP units of distance.  Reverb time
    constants are set by REVERBTC1 and REVERBTC2... prime numbers which correspond
    roughly to 50 and 40 milliseconds.
*/

#define MINREVERB 20
#define REVERBSTEP 10
#define REVERBTC1 2039
#define REVERBTC2 1777

/*
    intBits and fractBits define the portions of a 32-bit word to be used
    for a fixed-point number.  The integer portion must be long enough to hold
    a signed number twice the magnitude of MAXDELTA.  fractMask must correspond
    to the rightmost fractBits in the word.
*/

/*
    Utility.c - utility functions
*/

#include <math.h>
#include "CSounderParms.h"
#include "Utility.h"

#define PI              3.14159265

/*
    Alpha cuts are available from 0 dB (flat) to 20 dB.
*/

int alphaTable[NUMALPHAVALUES] = {0, 15, 27, 38, 48, 56, 64, 72, 77, 82, 88, 92, 96,
                                  102, 103, 105, 107, 110, 112, 113, 115};

/*
    Beta cuts are available from 0 dB (flat) to 9 dB.
*/

int betaTable[NUMBETAVALUES] = {0, 15, 30, 46, 59, 73, 87, 102, 112, 127};

/*
    Scrambler table (gray-code)
*/

int scrambleTable[NUMSCRAMBLES] = {0, 1, 3, 2 /* 6, 7, 5, 4,
                                   12, 13, 15, 14, 10, 11, 9, 8 */};

Point origin = {0,0};

int PtDist(Point p1, Point p2)
{
    long int d1, d2;
    d1 = p1.h - p2.h;
    d1 *= d1;
    d2 = p1.v - p2.v;
    d2 *= d2;
    return (int) (.5 + sqrt(d1 + d2));
}
```

```
int AbsAngle(Point p)
{
/*
   note that the point P is being represented with the Y axis reversed from
   the QuickDraw coordinate system... v > 0 is up, not down!
*/
    Fixed slope;
    int angle;
    if (p.h == 0) {
        if (p.v > 0) {
            return 0;
        } else {
            return 180;
        }
    }
    slope = FixRatio(p.h, -p.v);
    angle = AngleFromSlope(slope);
    if (p.h < 0) {
        return angle - 180;
    } else {
        return angle;
    }
}

Boolean SharpTurn(int angle1, int angle2, int criticalAngle)
{
    int deltaAngle;
    deltaAngle = angle1 - angle2;
    if (deltaAngle < 0) {
        deltaAngle = -deltaAngle;
    }
    if (deltaAngle < criticalAngle) {
        return FALSE;
    }
    return TRUE;
}

int AzimuthDelay(int theAngle)
{
    double realAngle;
    if (theAngle == 0 || theAngle == 180) {
        return 0;
    } else if (theAngle > 90) {
        theAngle = 180 - theAngle;
    } else if (theAngle < -90) {
        theAngle = -180 - theAngle;
    }
    realAngle = (theAngle * PI) / 180;
    return 123 * (realAngle + sin(realAngle)) /  22.675736961451; /* chuckle */
}

long int TimeToSamples(Fixed theTime)
{
    long int integerPart;
    unsigned int fractionalPart;
    integerPart = HiWord(theTime);
    fractionalPart = LoWord(theTime);
    return integerPart * SAMPLESPERSEC +
            ((unsigned long) fractionalPart) * SAMPLESPERSEC / 65536;
}

static int Lookup(int theTable[], int tableSize, double theValue)
{
    int theIndex, below, above, invert;
    double partial;
    if (theValue < 0.0) {
        invert = -1;
        theValue = -theValue;
    } else {
        invert = 1;
```

```
    }
    if (theValue > tableSize-1) {
        return invert * theTable[tableSize-1];
    }
    theIndex = theValue;
    below = theTable[theIndex];
    above = theTable[theIndex+1];
    partial = theValue - theIndex;
    return invert * (below + partial * (above - below));
}

void CSounderDoc::Sweep(CSoundPoint *startPoint, CSoundPoint *endPoint,
                        DistantSound *leftEar,
                        DistantSound *rightEar,
                        TimeCheck *now)
{
    long int dStart, dEnd;
    long int tStart, tEnd;
    long int hearStart, hearEnd;
    long int lagStart, lagEnd;
    long int deltaT, deltaH, runRate;
    static long int safePositive = 0x3FFFFFFF, safeNegative = 0xC0000000;
    int shiftCount;
    int startAngle, endAngle, deltaAngle, startDelta, endDelta;
    long int earDelta;
    long int earDiff, leftEarDiff, rightEarDiff;
    Fixed avgDistance;
    double avgAngle, rearRolloff, distanceRolloff,  notchCut, volumeDown;
    int volume;
    long int reverbLevel;
    dStart = PtDist(startPoint->where, origin);
    dEnd = PtDist(endPoint->where, origin);
    if (doppler) {
        lagStart = dStart * SAMPLESPERUNIT;
        lagEnd = dEnd * SAMPLESPERUNIT;
    } else {
        lagStart = lagEnd = 0;
    }
    tStart = TimeToSamples(startPoint->when);
    tEnd = TimeToSamples(endPoint->when);
    leftEar->startSound = rightEar->startSound = tStart;
    leftEar->finishSound = rightEar->finishSound = tEnd;
    if (now) {
        hearStart = now->time;
    } else {
        hearStart = tStart + lagStart;
    }
    hearEnd = tEnd + lagEnd;
    startAngle = AbsAngle(startPoint->where);
    endAngle = AbsAngle(endPoint->where);
    deltaAngle = startAngle - endAngle;
    avgAngle = ((startAngle + endAngle) / 2) * PI / 180;
    if (deltaAngle > 180 || deltaAngle < -180) {
        if (avgAngle > 0) {
            avgAngle = -PI + avgAngle;
        } else {
            avgAngle = PI + avgAngle;
        }
```

```
}
if (timePan) {
    if (now) {
        startDelta = (now->rightEarClock - now->leftEarClock) / 2;
    } else {
        startDelta = AzimuthDelay(startAngle);
    }
    endDelta = AzimuthDelay(endAngle);
} else {
    startDelta = endDelta = 0;
}
leftEar->startToHear = hearStart + startDelta;
leftEar->finishHearing = hearEnd + endDelta;
rightEar->startToHear = hearStart - startDelta;
rightEar->finishHearing = hearEnd - endDelta;
deltaT = tEnd - tStart;
deltaH = hearEnd - hearStart;
if (deltaT == deltaH) {
    runRate = 1L << fractBits;
} else {
    shiftCount = fractBits;
    while (shiftCount > 0 && (deltaT <= safePositive && deltaT >= safeNegative)) {
        deltaT = deltaT << 1;
        shiftCount --;
    }
    runRate = deltaT / deltaH;
    runRate = runRate << shiftCount;
}
earDelta = endDelta - startDelta;
if (deltaH == 0) {
    earDiff = 0;
} else {
    earDiff = earDelta << fractBits;
    earDiff /= deltaH;
}
leftEar->clockRate = runRate - earDiff;
rightEar->clockRate = runRate + earDiff;
if (earDiff > 0) {
    leftEar->clockStart = 1L << (fractBits - 1);
    rightEar->clockStart = 0;
} else {
    leftEar->clockStart = 0;
    rightEar->clockStart = 1L << (fractBits - 1);
}
avgDistance = dStart / 2 + dEnd / 2;
if (avgDistance <= NEARBY) {
    volume = 256;
    reverbLevel = MINREVERB;
} else {
    volume = (256L * NEARBY) / avgDistance;
    if (volume < VERYQUIET) {
        volume = VERYQUIET;
    }
    reverbLevel = MINREVERB + (avgDistance - NEARBY) / REVERBSTEP;
    if (reverbLevel > MAXREVERBLEVEL) {
        reverbLevel = MAXREVERBLEVEL;
    }
}
if (!distance) {
    volume = 256;
}
if (volumePan) {
    volumeDown = sin(fabs(avgAngle));
    if (avgAngle > 0) {
        leftEar->volume = volume * (1.0 - .9 * volumeDown);
        rightEar->volume = volume;
    } else {
        leftEar->volume = volume;
        rightEar->volume = volume * (1.0 - .9 * volumeDown);
    }
} else {
    leftEar->volume = rightEar->volume = volume;
```

```
}
if (reverb) {
    rightEar->reverbLevel = reverbLevel;
    leftEar->reverbLevel = reverbLevel - reverbLevel / 20; /* 5% reduction */
    leftEar->reverbTime = REVERBTC1;
    rightEar->reverbTime = REVERBTC2;
} else {
    leftEar->reverbLevel = rightEar->reverbLevel = 0;
    leftEar->reverbTime = rightEar->reverbTime = 0;
}
if (freqShape) {
    distanceRolloff = (avgDistance - NEARBY) / 100.0;        /* .1 dB/meter */
    if (avgAngle > 0) {
        if (avgAngle > PI/2) {
            rearRolloff = 10 * sin(avgAngle - PI/2);
        } else {
            rearRolloff = 0;
        }
        leftEar->hfRolloff = 10 * sin(avgAngle) + rearRolloff + distanceRolloff;
        rightEar->hfRolloff = rearRolloff + distanceRolloff;
        } else {
            if (avgAngle < -PI/2) {
                rearRolloff = 10 * sin(-PI/2 - avgAngle);
            } else {
                rearRolloff = 0;
            }
            leftEar->hfRolloff = rearRolloff + distanceRolloff;
            rightEar->hfRolloff = 10 * sin(-avgAngle) + rearRolloff + distanceRolloff;
        }
        leftEar->notch = leftEar->hfRolloff / 2;
        rightEar->notch = rightEar->hfRolloff / 2;
        if (avgAngle >= -PI/2 && avgAngle <= PI/2) {
            notchCut = 5 * cos(avgAngle);
        } else {
            notchCut = -5 * cos(avgAngle);
        }
        leftEar->notch += notchCut - 2.5;
        rightEar->notch += notchCut - 2.5;
        leftEar->alphaLevel = Lookup(alphaTable, NUMALPHAVALUES, leftEar->notch);
        rightEar->alphaLevel = Lookup(alphaTable, NUMALPHAVALUES, rightEar->notch);
        leftEar->beta = Lookup(betaTable, NUMBETAVALUES, leftEar->hfRolloff);
        rightEar->beta = Lookup(betaTable, NUMBETAVALUES, rightEar->hfRolloff);
    } else {
        leftEar->alphaLevel = leftEar->beta = 0;
        rightEar->alphaLevel = rightEar->beta = 0;
    }
    leftEar->alphaCount = rightEar->alphaCount = 3;

}


OSErr CSounderDoc::SendCommand(SndChannelPtr theChannel, int cmd,
                               int param1, long int param2)
{
    SndCommand theCommand;
    theCommand.cmd = cmd;
    theCommand.param1 = param1;
    theCommand.param2 = param2;
    return (SndDoCommand(theChannel, &theCommand, FALSE));
}

void CSounderDoc::CleanTimeline()
{
    int         n;
    CSoundPoint *pointN;
    n = 1;
    while (n <= timeline->GetNumItems()) {
        pointN = (CSoundPoint *) timeline->NthItem(n);
        if (pointN->GetType() == intermediatePoint) {
            timeline->Remove(pointN);
            pointN->Dispose();
        } else {
            n++;
```

```
        }
    }
}

void CSounderDoc::SliceTimeline()
{
    int         n;
    CSoundPoint *pointN, *pointNpl, *pointNew;
    Point       pN, pNpl, pMid;
    int         angleN, angleNpl, angleMid;
    int         dN, dNpl, dMid;
    int         dNtoMid, dMidtoNpl, dTotal;
    Fixed       criticalDistanceRatio;
    int         criticalAngle;

    criticalDistanceRatio = FixRatio(5, 100); /* change of 5% triggers cut */
    criticalAngle = 5; /* change of 5 degrees triggers cut */

    CleanTimeline();

    n = 1;
    while (n < timeline->GetNumItems()) {
        pointN = (CSoundPoint *) timeline->NthItem(n);
        pointNpl = (CSoundPoint *) timeline->NthItem(n+1);
        pN = pointN->GetWhere();
        pNpl = pointNpl->GetWhere();
        pMid.h = (pN.h + pNpl.h) / 2;
        pMid.v = (pN.v + pNpl.v) / 2;
        dTotal = PtDist(pN, pNpl);
        dN = PtDist(pN, origin);
        dNpl = PtDist(pNpl, origin);
        dMid = PtDist(pMid, origin);
        dNtoMid = dN - dMid;
        if (dNtoMid < 0) {
            dNtoMid = -dNtoMid;
        }
        dMidtoNpl = dMid - dNpl;
        if (dMidtoNpl < 0) {
            dMidtoNpl = -dMidtoNpl;
        }
        angleN = AbsAngle(pN);
        angleNpl = AbsAngle(pNpl);
        angleMid = AbsAngle(pMid);
        if (dTotal >= 10 && (SharpTurn(angleN, angleMid, criticalAngle) ||
          SharpTurn(angleMid, angleNpl, criticalAngle) ||
          FixRatio(dNtoMid, dMid) >= criticalDistanceRatio ||
          FixRatio(dMidtoNpl, dMid) >= criticalDistanceRatio)) {
            pointNew = new(CSoundPoint);
            pointNew->ISoundPoint();
            pointNew->SetType(intermediatePoint);
            pointNew->SetWhere(pMid);
            pointNew->SetWhen((pointN->GetWhen() + pointNpl->GetWhen()) / 2);
            timeline->InsertAfter(pointNew, pointN);

        } else {
            n++;
        }
    }
}
```

What is claimed is:

1. A method of generating sound that would be associated with an object moving respectively to the listener comprising the steps:

a) generating a ratio between the length of time that said object would generate such a sound and the length of time that the listener would hear said sound; and b) generating a series of digital sound samples as a function of said ratio for the period of time that said listener would have heard said sound.

2. The method of claim 1 wherein said ratio is a digital value having an integer portion and a fraction portion.

3. The method of claim 2 wherein each one of said series of generated digital sound samples is preceded by an immediately preceding digital sound sample except for the first digital sound sample in said series of digital sound samples and where each said digital sound sample is generated by the steps of:

c) forming a summation ratio, having an integer portion and a fraction portion, by combining said ratio and said fraction portion of the summation ratio generated for said immediately preceding sound sample of said series of sound samples except for the first of said digital sound sample where said fraction portion of the summation ratio for said immediately preceding sound sample has a value of zero; and d) generating a digital sound sample having a value which is a function of said summation ratio for said sound sample being generated.

4. The method of claim 3 further comprising the steps of:

e) providing a plurality of digital monaural sound samples representing the sound of said object when said object is at a constant distance from the listener.

5. The method of claim 4 wherein the step of generating each said digital sound sample further comprises the steps of:

f) selecting two of said provided digital monaural sound samples as a function of said integer portion of said summation ratio for the digital sound sample to be generated; and g) interpolating between the values of said two selected digital sound samples as a function of said fraction portion of said summation ratio for the sample to be generated, the resulting value of said interpolation being the value of the digital sound sample being generated.

6. A method for generating three dimensional binaural sound that a listener would hear from an object generating that sound where said object is moving with respect to the listener comprising the steps of:

a) storing a plurality of digital monaural sound samples having been sampled at a sample rate;

b) storing a segment which comprises data for describing the relative movement of said object to said listener in both space and time for said segment;

f) generating from said segment data a right ratio between the length of time that said object would generate sound ($\Delta T$) and the length of time that said generated sound would be heard by the listener's right ear, said first ratio comprising an integer and fraction portion;

g) generating a series of right digital sound samples for the length of time said generated sound would be heard by the listener'right ear as a function of said first ratio, where each said right digital sound sample is preceding by an immediately preceding right digital sound sample except for the first right digital sound sample of said series of right digital sound samples;

h) generating from said segment data a left ratio between the length of time that said object generates sound and the length of time that said generated sound is heard by the listener's left ear, second ratio comprising an integer and fraction portion;

i) generating a series of left digital sound samples for the length of time said generated sound would be heard by the listener's left ear as a function of said second ratio, where each said left digital sound sample is preceding by an immediately preceding left digital sound sample except for the first left digital sound sample of said series of left digital sound samples.

7. The method of claim 6 wherein the step of generating each one of said series of said right digital sound samples comprises the step of:

j) forming a right summation ratio, having an integer portion and a fraction portion, by combining said first ratio and said fraction portion of the right summation ratio generated for said immediately preceding right digital sound sample of said series of said right digital sound samples except for the first of said right digital sound sample where said fraction portion of the right summation ratio for said immediately preceding right digital sound sample has a value of zero; and wherein the step of generating each one of said series of left digital sound samples comprises the step of:

k) forming a left summation ratio, having an integer portion and a fraction portion, by combining said second ratio and the fraction portion of the left summation ratio generated for the immediately preceding left digital sound sample of said series of said left digital sound samples except for the first of said left digital sound sample where said fraction portion of the left summation ratio for said immediately preceding left digital sound sample has a value of zero.

8. The method of claim 7 comprising the further steps of:

c) storing segment criteria;

d) determining if said segment meets the requirement of said segment criteria;

e) dividing said segment into subsets of said segment where each said subset meets the requirements of said segment criteria if said segment did not meet the requirement of said segment criteria.

9. The method of claim 8 wherein said segment criteria of step d is:

if

1) $|d_1-d_m|<0.05\ d_m$ and

2) $|d_2-d_m|<0.05\ d_m$ and

3) $\beta_1<5°$ and

4) $\beta_2<5°$ are all met or if:

$d_m<10$ units where $d_1$ is the distance from the segments starting point in space $P_1$ of the sound source to the center of the listener's head;

$d_2$ is the distance from the segments ending point in space $P_2$ of the sound source to the center of the listener's head;

$d_m$ is the segments average distance $P_m$ of the sound source to the center of the listener's head;

$\beta_1$ is the angle between $P_1$ and $P_m$ from the center of the listeners head; and $\beta_2$ is the angle between $P_2$ and $P_m$ from the center of the listeners head;

then said segment meets said requirements, otherwise said segment being processed is divided into subsegments.

10. The method of claim 6 wherein:

said first ratio ($R_R$) of step f is generated in accordance with the mathematical formula $$R_R = \frac{\Delta T}{\Delta t - t_h(\sin\phi_1 - \sin\phi_2)}\text{; and}$$

said second ratio ($R_L$) of step h is generated in accordance with the mathematical formula $$R_L = \frac{\Delta T}{\Delta t + t_h(\sin\phi_1 - \sin\phi_2)},$$

where $\Delta T$ is the length of time that the sound is generated by the sound source during the segment;

$\Delta t$ is the length that the sound generated by the sound source would be heard at the center of the listeners head;

$t_h$ is one half the length of time for sound to travel the width of the average listeners head;

$\phi_1$ is the angle between an axis extending from a point directly in front of the listeners head through the center of the listeners head to a point directly behind the listeners head and a line from the segment starting point $P_1$ of the sound source in space and the center of the listeners head; and $\phi_2$ is the angle between an axis extending from a point directly in front of the listeners head through the center of the listeners head to a point directly behind the listeners head and a line from the segment ending point $P_2$ of the sound source in space and the center of the listeners head.

11. The method of claim 7 wherein:

said first ratio ($R_R$) of step f is generated in accordance with the mathematical formula $$R_R = \frac{\Delta T}{\Delta t - t_h(\sin\phi_1 - \sin\phi_2)}\text{; and}$$

said second ratio ($R_L$) of step h is generated in accordance with the mathematical formula $$R_L = \frac{\Delta T}{\Delta t + t_h(\sin\phi_1 - \sin\phi_2)},$$

where $\Delta T$ is the length of time that the sound is generated by the sound source during the segment;

$\Delta t$ is the length that the sound generated by the sound source would be heard at the center of the listeners head;

$t_h$ is one half the length of time for sound to travel the width of the average listeners head;

$\phi_1$ is the angle between an axis extending from a point directly in front of the listeners head through the center of the listeners head to a point directly behind the listeners head and a line from the segment starting point $P_1$ of the sound source in space and the center of the listeners head; and $\phi_2$ is the angle between an axis extending from a point directly in front of the listeners head through the center of the listeners head to a point directly behind the listeners head and a line from the segment ending point $P_2$ of the sound source in space and the center of the listeners head.

12. The method of claim 7 wherein:

said first ratio ($R_R$) of step f is generated in accordance with the mathematical formula $$R_R = \frac{\Delta T + t_h(\sin\phi_1 - \sin\phi_2)}{\Delta t}\text{; and}$$

said second ratio ($R_L$) of step h is generated in accordance with the mathematical formula $$R_L = \frac{\Delta T - t_h(\sin\phi_1 - \sin\phi_2)}{\Delta t}$$

where $\Delta T$ is the length of time that the sound is generated by the sound source during the segment;

$\Delta T$ is the length that the sound generated by the sound source would be heard at the center of the listeners head;

$t_h$ is one half the length of time for sound to travel the width of the average listeners head;

$\phi_1$ is the angle between an axis extending from a point directly in front of the listeners head through the center of the listeners head to a point directly behind the listeners head and a line from the segment starting point $P_1$ of the sound source in space and the center of the listeners head; and $\phi_2$ is the angle between an axis extending from a point directly in front of the listeners head through the center of the listeners head to a point directly behind the listeners head and a line from the segment ending point $P_2$ of the sound source in space and the center of the listeners head.

13. The method of claim 7 wherein step j comprises the steps of:

j1) sequentially fetching said digital monaural sound samples from said storage where the number of said digital monaural sound samples fetched is a function of said present right summation ratio;

j2) storing said fetched digital monaural sound samples;

j3) interpolating between the values of the last two stored digital monaural sound samples, the interpolation factor for said interpolation being a function of said fraction portion of said right summation ratio, for generating said right digital sound sample; and wherein step k comprises the steps of:

k1) sequentially fetching said digital monaural sound samples from said storage where the number of said digital monaural sound samples fetched is a function of said integer portion of said left summation ratio;

k2) storing said fetched digital monaural sound samples;

k3) interpolation between the values of the last two stored digital monaural sound samples, the interpolation factor for said interpolation being a function of said fraction portion of said left summation ratio, for generating said left digital sound sample; and said right and left digital sound samples being generated at the same rate as said sample rate for said digital monaural sound samples.

14. The method of claim 7 comprising the additional steps of:

l) receiving and storing reverberation data;

m) generating a right reverberation signal and a left reverberation signal as a function of said reverberation data;

n) adding said right reverberation signal to said right digital sound samples to form a right reverberized digital sound sample; and o) adding said left reverberation signal to said left digital sound sample to form a left reverberized digital sound sample.

15. The method of claim 13 comprising the additional steps of:

l) receiving and storing reverberation data;

m) generating a right reverberation signal and a left reverberation signal as a function of said reverberation data;

n) adding said right digital reverberation signal to said right digital sound sample to form a right reverberized digital sound sample; and o) adding said left reverberation signal to said left digital sound sample to form a left reverberized digital sound sample.

16. The method of claim 7 comprising the additional steps of:

p) generating a set of right control values for a right digital notch filter and a right digital low pass filter as a function of said segment;

q) setting said right digital notch filter and said right digital low pass filter by said right set of control values;

r) filtering said right digital sound sample by said right digital notch filter and said right digital low pass filter for forming a right filtered digital sound sample;

s) generating a set of left controlled values for a left digital notch filter and a left digital low pass filter as a function of said segment;

t) setting said left digital notch filter and said left digital low pass filter by said left set of control values;

u) filtering said left digital sound sample by said left digital notch filter and said left digital low pass filter for forming a left filtered digital sound sample.

17. The method of claim 13 comprising the additional steps of:

p) generating a set of right control values for a right digital notch filter and a right digital low pass filter as a function of said segment;

q) setting said right digital notch filter and said right digital low pass filter by said right set of control values;

r) filtering said right digital sound sample by said right digital notch filter and said right digital low pass filter for forming a right filtered digital sound sample;

s) generating a set of left controlled values for a left digital notch filter and a left digital low pass filter as a function of said segment;

t) setting said left digital notch filter and said left digital low pass filter by said left set of control values;

u) filtering said left digital sound sample by said left digital notch filter and said left digital low pass filter for forming a left filtered digital sound sample.

18. The method of claim 15 comprising the additional steps of:

p) generating a set of right control values for a right digital notch filter and a right digital low pass filter as a function of said segment;

q) setting said right digital notch filter and said right digital low pass filter by said right set of control values;

r) filtering said right reverberized digital sound sample by said right digital notch filter and said right digital low pass filter for forming a right filtered digital sound sample;

s) generating a set of left control values for a left digital notch filter and a left digital low pass filter as a function of said segment;

t) setting said left digital notch filter and said left digital low pass filter by said left set of control values;

u) filtering said left reverberized digital sound sample by said left digital notch filter and said left digital low pass filter for forming a left filtered digital sound sample.

19. The method of claim 16 comprising the additional steps of:

v) generating a volume control value as a right volume multiplier and a left volume multiplier as a function of said segment;

w) multiplying said right digital sound sample by said right volume multiplier for forming a right volume adjust digital sound sample;

x) multiplying said left digital sound sample by said left volume multiplier for forming a left volume adjust digital sound sample;

y) converting said right volume adjust digital sound sample into a right analog signal for the right ear of said listener; and z) converting said left volume adjusted digital sound samples into a left analog signal for the left ear of said listener.

20. The method of claim 17 comprising the additional steps of:

v) generating a volume control value as a right volume multiplier and a left volume multiplier as a function of said segment;

w) multiplying said digital sound sample by said right volume multiplier for forming a right volume adjust digital sound sample;

x) multiplying said left digital sound sample by said left volume multiplier for forming a left volume adjust digital sound sample;

y) converting said right volume adjust digital sound sample into a right analog signal for the right ear of said listener; and z) converting said left volume adjusted digital sound sample into a left analog signal for the left ear of said listener.

21. The method of claim 18 comprising the additional steps of:

v) generating a volume control value as a right volume multiplier and a left volume multiplier as a function of said input data;

w) multiplying said right reverberized digital sound sample by said right volume multiplier for forming a right volume adjust digital sound sample;

x) multiplying said left reverberized digital sound sample by said left volume multiplier for forming a left volume adjust digital sound sample;

y) converting said right volume adjust digital sound sample into a right analog signal for the right ear of said listener; and z) converting said left volume adjusted digital sound samples into a left analog signal for the left ear of said listener.

* * * * *

UNITED STATES PATENT AND TRADEMARK OFFICE

CERTIFICATE OF CORRECTION

PATENT NO. : 5,337,363

DATED : August 9, 1994

INVENTOR(S) : David C. Platt

It is certified that error appears in the above-identified patent and that said Letters Patent is hereby corrected as shown below:

Column 37, Line 4; Column 38, Lines 7, 19: "sample should be --samples--;
Column 37, Line 35: between "ples" and "having", insert --associated with said object, said digital monaural sound samples--;
Column 37, Line 48: "listener'right" should be --listener's right--;
Column 37, Lines 50, 63: the first "preceding" should be --preceded--;
Column 38, Lines 26, 31: "requirement" should be --requirements--;
Column 38, Lines 42, 45, 48: "segments" should be --segment's--;
Column 38, Lines 51, 53; Column 39, Lines 6, 8, 10, 11, 12, 14, 16, 17, 18, 20, 41, 43, 45, 46, 47, 49, 51, 52, 53, 55; Column 40, Lines 6, 8, 10, 11, 12, 14, 16, 17, 18: "listeners" should be --listener's--;
Column 40, Line 4: "ΔT" should be --Δt--;
Line 26: between "tion" and "of", insert --of said integer portion--;
Line 43: "interpolation" should be --interpolating--;
Line 58: "samples" should be --sample--;
Column 42, Lines 23, 44, 62: "adjusted" should be --adjust--.

Signed and Sealed this

Twenty-second Day of November, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,337,363

DATED : August 9, 1994

INVENTOR(S) : David C. Platt

It is certified that error appears in the above-identified patent and that said Letters Patent is hereby corrected as shown below:

Column 37, line 44, "first" should be --right--;

Column 37, line 62, "second" should be --left--;

Column 38, line 3, "first" should be --right--;

Column 38, line 15, "second" should be --left--;

Column 38, line 59, "first" should be --right--;

Column 38, line 65, "second" should be --left--;

Column 39, line 22, "first" should be --right--;

Column 39, line 29, "second" should be --left--;

Column 39, line 58, "first" should be --right--; and

Column 39, line 64, "second" should be --left--.

Signed and Sealed this

Twenty-fifth Day of July, 1995

*Attest:*

Bruce Lehman

BRUCE LEHMAN

*Attesting Officer*

*Commissioner of Patents and Trademarks*